US005362611A

United States Patent [19]

Kawai et al.

[11] Patent Number: 5,362,611

[45] Date of Patent: Nov. 8, 1994

[54] SILVER HALIDE PHOTOGRAPHIC MATERIAL

[75] Inventors: Kiyoshi Kawai; Toru Harada, both of Minami-Ashigara, Japan

[73] Assignee: Fuji Photo Film Co., Ltd., Minami-Ashigara, Japan

[21] Appl. No.: 966,838

[22] Filed: Oct. 27, 1992

[30] Foreign Application Priority Data

Oct. 30, 1991 [JP] Japan ..... 3-310143

[51] Int. Cl.[5] ..... G03C 1/08

[52] U.S. Cl. ..... 430/508; 430/517; 430/559; 430/576; 430/588; 430/950

[58] Field of Search ..... 430/508, 559, 517, 588, 430/950, 576

[56] References Cited

U.S. PATENT DOCUMENTS

| | | | |
|---|---|---|---|
| 4,326,023 | 4/1982 | DeSeyn | 430/588 |
| 4,619,892 | 10/1986 | Simpson et al. | 430/505 |
| 4,801,525 | 1/1989 | Mihara et al. | 430/517 |
| 5,075,205 | 12/1991 | Inagaki et al. | 430/517 |
| 5,185,236 | 2/1993 | Shiba et al. | 430/505 |

FOREIGN PATENT DOCUMENTS

| | | |
|---|---|---|
| 0383265 | 8/1990 | European Pat. Off. . |
| 0420011 | 4/1991 | European Pat. Off. . |
| 1558999 | 1/1969 | France . |

OTHER PUBLICATIONS

Patent Abstracts of Japan, JP62-3250 (Jan. 1987).
Patent Abstracts of Japan, JP62-103633 (May, 1987).
Patent Abstracts of Japan, JP1-23104 (Sep. 1989).
Patent Abstracts of Japan, JP1-257843 (Oct. 1989).
Patent Abstracts of Japan, JP2-129627 (May, 1990).

*Primary Examiner*—Charles L. Bowers, Jr.
*Assistant Examiner*—Geraldine Letscher
*Attorney, Agent, or Firm*—Burns, Doane, Swecker & Mathis

[57] ABSTRACT

There is provided a silver halide photographic material which comprises a support having thereon at least three kinds of silver halide light-sensitive emulsion layers differing from one another in color sensitivity, at least two kinds of which comprise silver halide emulsion grains sensitized spectrally with sensitizing dyes providing their respective spectral sensitivity maxima at wavelength of longer than about 570 nm, with the photographic material further containing at least one water-soluble dye which is selected from eight groups having specified structural formulae respectively and has an absorption maximum at wavelengths longer than about 570 nm, thereby acquiring an aptitude with scanning exposure using at least two kinds of light sources capable of emitting monochromatic high-intensity beams of wavelengths longer than 570 nm and ensuring high resolving power without attended by aggravation of color separation.

12 Claims, 2 Drawing Sheets

SILVER HALIDE PHOTOGRAPHIC MATERIAL

FIELD OF THE INVENTION

The present invention relates to silver halide photographic materials suitable for forming images through scanning exposure with high density beams of light such as those emitted from laser devices, light emission diodes or the like.

BACKGROUND OF THE INVENTION

In recent years, arts of transmitting image information in the form of electric signals, and storing it at the reception points or reproducing it on CRT have been developed remarkably. In parallel with development of these arts, the demand for the production of hard copies from the transmitted image information has been increasing, and in response thereto various means of obtaining hard copies have been proposed. For instance, electrophotographic methods and heat-sensitive transfer methods utilizing sublimation of dyes have been applied. However, most of hard copies obtained using such methods are poor in image quality. As for the color hard copies in particular, the quality thereof has no comparison with that of prints using color papers on the market. In addition, there is a method of obtaining hard copies from digital image information by the use of silver salt photography, wherein CRT is used for exposure in obtaining printed images. As the situation now stands, however, satisfactory image quality is not yet obtained for a reason that CRT beams have a large spot area, and so on. As a system which can offer hard copies of high quality, on the other hand, there are on the market "Pictrography", trade name, produced by Fuji Photo Film Co., Ltd., and the like, which utilizes the combination of an image formation method comprising processes of the heat development of silver halide and the diffusion of dyes with an exposure method comprising scanning exposure with LED. However, such a system has a price problem.

Meanwhile, rapid and cheap service of extremely high quality prints is now performed with relatively ease owing to improvements in silver halide photosensitive materials and the progress of compact, simple and rapid development system (e.g., a minilab system). After the analogy of this, the demand for materials which can provide hard copies of image information at a low price, enable simple and rapid processing, and ensure steady acquisition of their properties and high image quality is now strong and growing.

In the method of obtaining hard copies from electric signals, a scanning exposure system in which exposure is performed as image information is picked out successively is generally adopted. Therefore, sensitive materials suitable for this system are required.

As for the scanning exposure applicable to image formation, there is a so-called scanner system. Various kinds of recording apparatuses utilizing the scanner system are on the market. As a recording light source installed in such recording apparatuses, a glow lamp, a xenon lamp, a mercury lamp, a tungsten lamp, a light emitting diode and so on have so far been used. However, all of these light sources are weak in generating power and have a short span of life, and so they are undesirable from the practical point of view. As light sources which enable obviation of the defects of such light sources, devices for emission of coherent light, such as gas laser, e.g., He-Ne laser, argon laser, He-Cd laser, etc., and semiconductor laser, are usable. In practice, there are scanners using those laser devices as a light source.

Although it is high in generating power, gas laser has a defect that it requires a large-sized expensive device for generating laser beams and a modulator, and so on.

in comparison with gas laser, semiconductor laser has many advantages. For instance, semiconductor laser devices are small in size and low in price, laser beams generated therefrom can be modulated with ease, and a life-span thereof is longer than that of gas laser devices. Since wavelengths of laser beams emitted from semiconductor devices are mainly within a range of from red to infrared region, it is required of photosensitive materials to have high spectral sensitivities at the wavelengths ranging from red to infrared region.

However, most of sensitizing dyes which can confer spectral sensitivities on photosensitive materials within the wavelength range from red to infrared region are those of monomer band type, and so the wavelength dependence of the spectral sensitivities gained is generally indistinct. Supposing a full color photosensitive material for exposure to laser beams (exposure wavelengths: λa, λb and λc) is designed using those sensitizing dyes (for example, so as to form a yellow color by exposure to a laser beam of λa, a magenta color by exposure to a laser beam of λb and a cyan color by exposure to a laser beam of λc), unnecessary colors will be formed in high density areas of the color intended to be formed because light-sensitive layers, other than the proper light-sensitive layer to form a color by exposure to a given laser beam, will also have some sensitivity to said laser beam owing to broad distribution of spectral sensitivities given thereto by sensitizing dyes. (More specifically, if a magenta color is formed by exposure to a laser beam of λb, yellow and cyan colors also will come to be formed as the quantity of beam is increased in said exposure.) This supposition suggests that the use of sensitizing dyes of monomer band type results in unsatisfactory color separation.

In general, conventional color photosensitive materials have been designed so as to form a yellow color by exposure to blue light, a magenta color by exposure to green light and a cyan color by exposure to red light. Therein, J-band type sensitizing dyes sharp in distribution of spectral sensitivities provided thereby have been used as sensitizing dyes (for blue-sensitive and green-sensitive layers) and wavelength regions of exposure lights have been kept apart from each other (by rendering constituent layers green-sensitive and red-sensitive, respectively), whereby having avoided the foregoing problem. However, it is the present situation that J-band type sensitizing dyes which can produce desired effects in the range from red to infrared region are little known. Moreover, there is a limitation on wavelengths of laser beams which can be used stably. As a result of it, a wavelength difference between every desirable pair of exposure beams becomes at most 80 nm or so. Therefore, the insufficiency in color separation, which may be left out of consideration in case of conventional photosensitive materials, becomes a grave problem in designing full color photosensitive materials utilizing semiconductor laser beams as light source for exposure.

As means of improving color separation in the range from red to infrared region, there can be thought up various ideas of, e.g., (1) making an ample difference in sensitivity between each pair of light-sensitive layers, (2) designing a photosensitive material so as to produce contrasty image, (3) using sensitizing dyes capable of providing spectral sensitivities distributed as narrowly as possible, and (4) providing a filter layer between light-sensitive layers which have a need for color separation, and so inhibiting as completely as possible the light for sensitization of the upper layer from reaching the lower layer.

As for the means (1), it is a general measure and common-sense to those designing photographic materials. However, adoption of this means is attended by difficulties in designing emulsions and selecting laser devices.

As for the means (2), it has an advantage in color separation, but imparting a contrasty characteristic to a photosensitive material signifies that a slight fluctuation of the quantity of light results in a great change of density. Accordingly, this means undergoes a great influence of fluctuation, e.g., in an exposure apparatus, and so the system control becomes very difficult.

As for the means (3), it is a concrete measure to use J-band sensitizing dyes. However, as previously described, J-band type sensitizing dyes capable of exhibiting desirable effects in the infrared region have scarcely been found. On the other hand, it is known that infrared sensitizing dyes of monomer type can provide narrowly distributed spectral sensitivities by assuming rigidly selected structures, as disclosed in JP-A-03-20730 (The term "JP-A" as used herein means an "unexamined published Japanese patent application"), European Patents 0420011 and 0420012. However, effects produced by some of such dyes are slight, and some others are inferior in stability or exert adverse effects on photographic properties.

As for the means (4), there can be taken such a measure as to provide a nondiffusible filter layer between two light-sensitive layers in order to reduce as sharply as possible the rays of light, to which the upper layer is sensitive, in the quantity to reach the lower layer, as disclosed in U.S. Pat. No. 4,619,892. However, such a nondiffusible filter layer tends to cause color stain after photographic processing, which brings on a serious problem to hard copies using a reflecting support. This problem becomes more serious the more sharply the development time is reduced for the purpose of rapid production of hard copies.

Therefore, it can be said that development of photosensitive materials well-suited for the exposure using semiconductor laser and excellent in color separation is quite difficult.

Moreover, the exposure using rays of light having high density and long wavelengths, such as laser beams of wavelengths ranging from red to infrared region, is attended by considerable spread of rays arising from halation and irradiation phenomena, and so it causes great deterioration in resolution. Accordingly, water-soluble dyes are used for preventing the rays from spreading through the photosensitive material and for heightening the sharpness. In general, it has so far been carried out to use water-soluble dyes for the purpose of preventing silver halide photographic materials from suffering irradiation. For instance, JP-A-02-157749 discloses a color photosensitive material which has at least two light-sensitive layers sensitized spectrally so as to respond to laser beams of wavelengths longer than 670 nm and is colored with a coloring material which can be decolored during photographic processing. As a material which has both colorability and decolorability, oxonol dyes, hemioxonol dyes, merocyanine dyes, cyanine dyes and the like are known generally. While it was believed that any of those dyes can be used for prevention of irradiation as far as their absorption wavelengths are in a desirable range and they hardly generate color stain, it has turned out that color separation was aggravated by increasing an amount of the dye added with the invention of complete prevention of irradiation. Thus, the color separation problem in color photosensitive materials particularly designed so as to have an aptitude with the exposure to at least two kinds of semiconductor laser beams, which is intrinsically difficult, is made much more serious by linking up with the aggravation of color separation caused by water-soluble dyes.

At the present time, semiconductor laser devices and light emission diodes enable the use of laser beams having wavelengths longer than about 570 nm. In particular, semiconductor devices which can emit laser beams of wavelengths no shorter than 670 nm are already put to practical use.

SUMMARY OF THE INVENTION

Therefore, an object of the present invention is to provide a silver halide color photographic material which is well-suited for scanning exposure using at least two kinds of light sources capable of emitting monochromatic high-density light of wavelengths longer than about 570 nm, particularly no shorter than 670 nm, has high resolving power and is reduced in aggravation of color separation.

The above-described object is attained with a silver halide photographic material that comprises a support having thereon at least three kinds of silver halide light-sensitive layers differing from one another in color sensitivity, at least two kinds of which each comprise silver halide emulsion grains spectrally sensitized with a sensitizing dye providing a spectral sensitivity maximum at wavelength of no shorter than 570 nm, said photographic material further containing at least one water-soluble dye represented by the general formula (IV), (V), (VI), (VII), (VIII), (IX) or (X) illustrated below and having its absorption maximum at wavelength of no shorter than 570 nm.

Further, the foregoing object of the present invention is attained more effectively with a silver halide photographic material that comprises a support having thereon at least three kinds of silver halide light-sensitive layers differing in color sensitivity from one another, especially one which comprises a light-reflecting support having thereon at least three kinds of silver halide light-sensitive layers differing in color sensitivity from one another and containing any one of a yellow color-forming coupler, a magenta color-forming coupler and a cyan color-forming coupler respectively, at least two kinds of which each comprise silver halide emulsion grains spectrally sensitized with a sensitizing dye providing a spectral sensitivity maximum at wavelength of no shorter than 670 nm, said photographic material further containing at least one water-soluble dye represented by the general formula (IV), (V), (VI), (VII), (VIII), (IX) or (X) illustrated below and having its absorption maximum at wavelength of no shorter than 670 nm.

Furthermore, the foregoing object of the present invention is attained with a method of forming color images that comprises exposing the foregoing photographic materials to light using a scanning exposure system in which an exposure time per one picture element is at most $10^{-4}$ second and subjecting them to photographic processing which includes a color-development step. In particular, the image forming method of the present invention can fully achieve its effects when a color development time is 20 seconds at most and a total processing time for completing the photographic processing including from the color development step to a drying step is at most 90 seconds.

In accordance with embodiments of the present invention, color photographs having an excellent image sharpness can be obtained quickly with aggravation of color separation.

There, the FIG. 10 represents an image-forming apparatus proper, the FIG. 12 a developing tank, the FIG. 14 a bleach-fix tank, the FIG. 16 a washing tank, the FIG. 17 a draining unit, the FIG. 18 a drying unit, the FIG. 20 a sensitive material, the FIG. 30 a processing solution-jetting device, and the FIG. 32 a pump.

Figure 2:
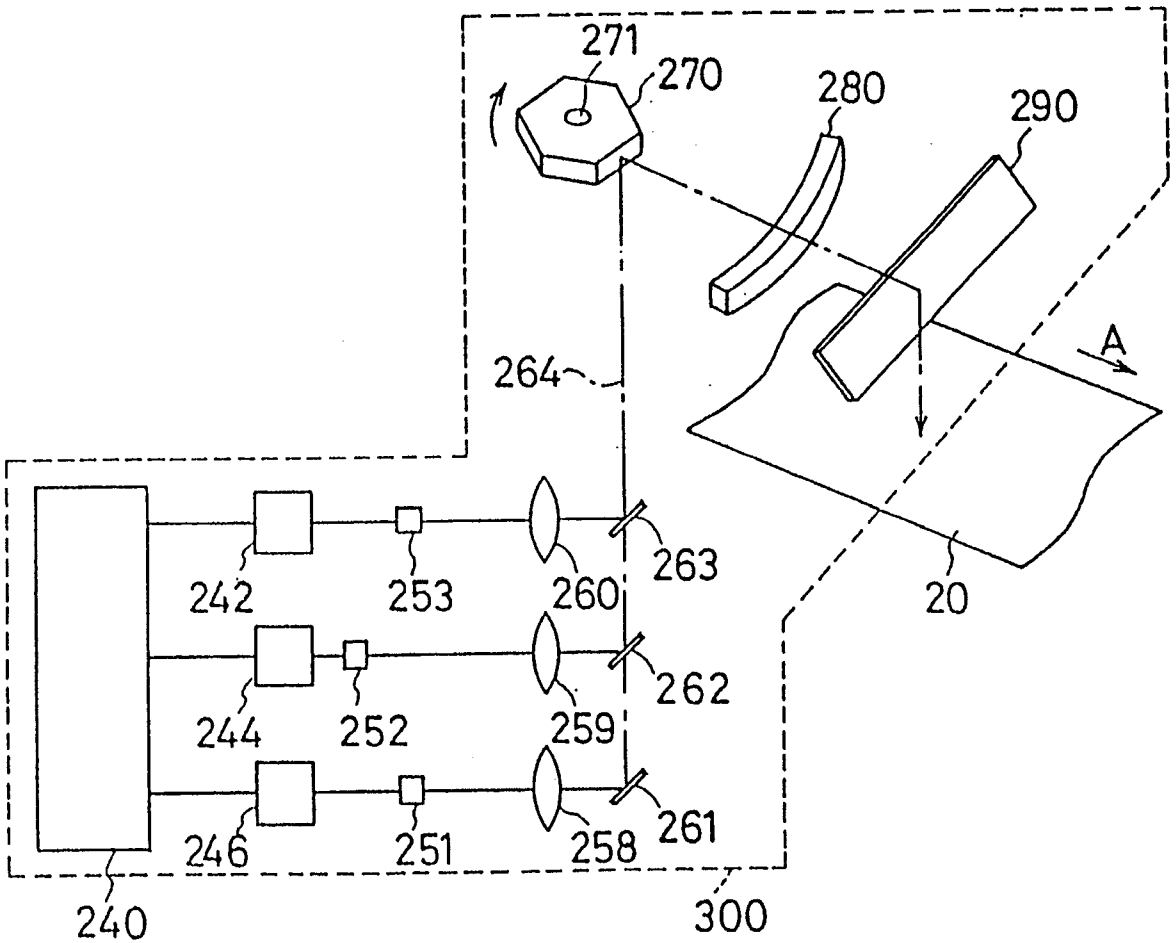

FIG. 2 is a schematic diagram of the exposure unit used in the present invention.

Therein, the FIG. 240 represents an image signal processor, the FIGS. 242, 244 and 246 driving circuits, the FIGS. 251, 252 and 253 semiconductor laser devices, the FIGS. 258, 259 and 260 collimater lenses, the FIG. 261 a total reflection mirror, the FIGS. 262 and 263 dichroic mirrors, the FIG. 270 a polygon mirror, the FIG. 280 a $f\theta$ lens, and the FIG. 300 an exposure unit.

DETAILED DESCRIPTION OF THE INVENTION

The terms "color sensitivity", "spectral sensitization" and "light-sensitive layer" used in the present invention are intended to include sensitivities to not only visible rays but also electromagnetic waves having wavelengths in the infrared region.

The dyes used in the present invention, which are represented by the following general formulae (IV) to (X), are described below in detail.

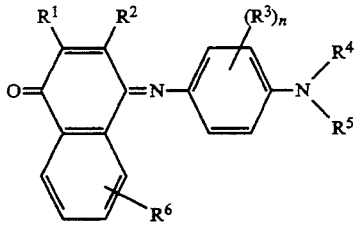

(IV)

In the above formula, $R^1$ represents a hydrogen atom, a halogen atom, a sulfonic acid group or a group of a formula $CONHR^7$, $SO_2NHR^7$, $NHCOR^7$, $NHCONHR^7$ or $NHSO_2R^7$, wherein $R^7$ represents a substituted or unsubstituted alkyl group, a substituted or unsubstituted aryl group or a substituted or unsubstituted heterocyclic group; $R^2$ represents a hydrogen atom, a substituted or unsubstituted alkyl group or a substituted or unsubstituted aryl group; $R^3$ represents a hydrogen atom, a halogen atom, a substituted or unsubstituted alkyl group, a hydroxyl group, a substituted or unsubstituted alkoxy group containing 1 to 5 carbon atoms (e.g., methoxy, ethoxy, 2-sulfoethoxy, methoxyethoxy) or a group represented by a formula $NHCOR^7$, $NHSO_2R^7$ or $NHCONHR^7$, wherein $R^7$ has the same meaning as described above; $R^4$ and $R^5$, which may be the same or different, each represent a substituted or unsubstituted alkyl group, a substituted or unsubstituted aryl group, an acyl group (e.g., acetyl, propionyl) or a sulfonyl group (e.g., methanesulfonyl, ethanesulfonyl), or $R^4$ may combine with $R^5$ or $R^3$ to form a 5- or 6-membered ring (e.g., a pyrrolidine ring, a piperizine ring, a morpholine ring) and $R^5$ also may combine with $R^3$ to form a 5- or 6-membered ring; $R^6$ represents a hydrogen atom, a sulfonic acid group or a group represented by a formula $NHCOR^7$, $NHSO_2R^7$, $SO_2NHR^7$ or $NHCONHR^7$, wherein $R^7$ has the same meaning as described above; and n represents an integer from 1 to 4 (when n is from 2 to 4$R^3$'s may be the same or different): provided that at least one of the groups represented by $R^1$, $R^2$, $R^3$, $R^4$, $R^5$ and $R^6$ contains a sulfonic acid group as a substituent.

Examples of a halogen atom represented by $R^1$ and $R^3$ include F, Cl and Br.

As an alkyl group represented by $R^2$, $R^3$, $R^4$, $R^5$ or $R^7$, a lower alkyl group containing 1 to 5 carbon atoms (e.g., methyl, ethyl, etc.) is preferred, and it may have a substituent group (e.g., sulfo, carboxyl, hydroxyl).

Suitable examples of an aryl group represented by $R^2$, $R^7$, or $R^4$ and/or $R^5$ include a substituted or unsubstituted phenyl group, and a substituted or unsubstituted naphthyl group. Examples of groups by which the phenyl group may be substituted include sulfonic acid group, carboxyl group, hydroxyl group, cyano group, a halogen atom (e.g., chlorine, fluorine), an 1-5C acyl group (e.g., acetyl, propionyl), a 1-5C sulfonyl group (e.g., methanesulfonyl, ethanesulfonyl, 2-sulfoethanesulfonyl, 3-sulfopropanesulfonyl), a 1-5C carbamoyl group (e.g., unsubstituted carbamoyl, methylcarbamoyl, 2-sulfoethylcarbamoyl, 2-carboxyethylcarbamoyl, 2-hydroxyethylcarbamoyl), a 1-5C sulfamoyl group (e.g., unsubstituted sulfamoyl, methylsulfamoyl, ethylsulfamoyl, 2-sulfoethylsulfamoyl, 2-carboxyethylsulfamoyl), a 1-5C alkoxycarbonyl group (e.g., methoxycarbonyl, ethoxycarbonyl, trichloroethyoxycarbonyl, trifluoroethoxycarbonyl), a 1-5C alkoxy group (e.g., methoxy, ethoxy), an amino group (e.g., dimethylamino, diethylamino). Examples of groups by which the naphthyl group may be substituted preferably include those cited in case of the phenyl group.

A substituted or unsubstituted heterocyclic group represented by $R^7$ may be monocyclic or condensed one, with suitable examples including monovalent groups derived from a 1,3-thiazole ring, a 1,3,4-triazole ring, a benzothiazole ring, a benzimidazole ring, a benzoxazole ring, a 1,3,4-thiadiazole ring and the like (which may contain as a substituent group a lower alkyl group such as methyl and ethyl, a lower alkoxy group such as methoxy and ethoxy, sulfo group, hydroxyl group and carboxyl group).

Of the dyes represented by the general formula (IV), preferably dyes are those containing as $R^1$ a group represented by the formula $CONHR^7$, $NHCOR^7$ or $NHSO_2R^7$ (wherein $R^7$ has the same meaning as described above), as $R^2$ a hydrogen atom, as $R^3$ a hydrogen atom, an alkyl group (which has the same definition as given above), an alkoxy group (which has the same definition as given above) or a group represented by $NHCOR^7$ or $NHCONHR^7$ (wherein $R^7$ has the same meaning as described above), as at least either $R^4$ or $R^5$ a sulfoalkyl group containing 2 to 4 carbon atoms, as $R^6$ a hydrogen atom or a group represented by $NHCOR^7$, $NHSO_2R^7$ or $NHCONHR^7$ (wherein $R^7$ has the same meaning as described above), and n of 1 or 2. In addition, it is essential for these dyes to contain at least two sulfonic acid groups in one or separate groups corresponding to $R^4$, $R^5$ or/and $R^7$.

Among the foregoing dyes, those preferred in particular are compounds represented by the following general formulae (IV-I), (IV-II) and (IV-III), respectively.

(IV-I)

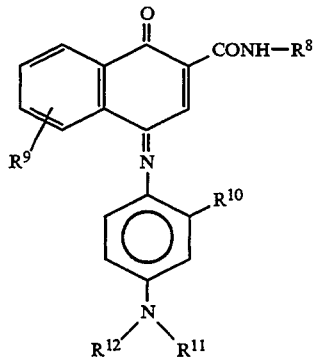

In the above formula, $R^8$ represents an alkyl group, an aryl group or a heterocyclic group; $R^9$ represents a hydrogen atom, a sulfonic acid group, a carboxylic acid group, a hydroxyl group or a halogen atom; $R^{10}$ represents a hydrogen atom, an alkyl group, an alkoxy group or an amino group; and $R^{11}$ and $R^{12}$ may be the same or different, each being an alkyl group. Moreover, it is essential for the dye molecule to contain at least 5 acid groups.

The substituent groups present in the formula (IV-I) have the same meanings as described in the formula (IV), respectively.

Additionally, it is desirable that at least two of the acidic substituents contained in the dye molecule should be carboxylic acid groups.

(IV-II)

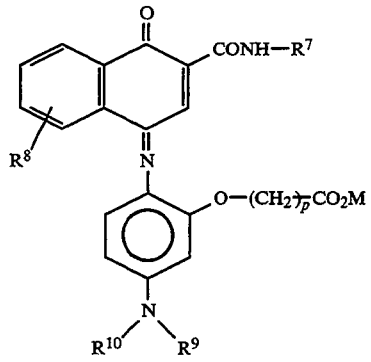

In the above formula, $R^7$ represents an alkyl group, an aryl group or a heterocyclic group; $R^8$ represents a hydrogen atom, a sulfonic acid group or a group represented by NHCOR, $NHSO_2R$, $SO_2NHR$ or NHCONHR, wherein R represents an alkyl group, an aryl group or a heterocyclic group; $R^9$ and $R^{10}$ may be the same or different, and each represents an alkyl group; p represents an integer from 1 to 5; and M represents an organic or inorganic ammonium salt or an alkali metal salt. In addition, it is essential for the dye molecule to contain at least 3 acidic substituents.

The substituent groups present in the formula (IV-II) have the same meanings as described in the formula (IV), respectively. It is desirable that these substituent groups should be chosen so that the dye molecule contains four, preferably five, acidic substituents. It is more desirable that at least two of these acidic substituents should be carboxylic acid groups.

In the foregoing general formula (IV-II), it is much more desirable that $R^8$ should be a group represented by NHCOR, $NHSO_2R$ or NHCONHR, wherein R represents an alkyl, aryl or heterocyclic group, $R^9$ and $R^{10}$ each should be an alkyl group, and at least 3, preferably 4, more preferably 5, acidic substituents should be contained in a dye molecule. Moreover, it is preferable in particular that at least two of the acidic substituents should be carboxylic acid groups.

(IV-III)

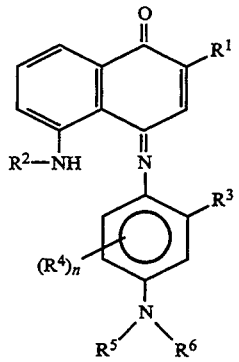

In the above formula, $R^1$ represents a hydrogen atom, a halogen atom, a sulfonic acid group, a carboxylic acid group, or a group of the formula CONHR, $SO_2NHR$, $NHSO_2R$, NHCOR or NHCONHR, wherein R is an alkyl, aryl or heterocyclic group; $R^2$ represents a group of the formula $SO_2R$, COR or CONHR, wherein R has the same meaning as above; $R^3$ and $R^4$ may be the same or different, and each represents a hydrogen atom, an alkyl group, an alkoxy group, a hydroxyl group, an amino group or a halogen atom; $R^5$ and $R^6$ may be the same or different, and each represents an alkyl group, an aryl group, an acyl group or a sulfonyl group, or they may combine with each other to complete a 5- or 6-membered ring; and n represents 0 or an integer from 1 to 3. In addition, it is essential for the dye molecule to contain at least 3 acidic substituents.

A detailed description of the foregoing formula (IV-III) is given below.

A halogen atom represented by $R^1$, $R^3$ and $R^4$ includes F, Cl and Br.

R in CONHR, $SO_2NHR$, $NHSO_2R$, NHCOR and NHCONHR represented by $R^1$ represents an alkyl group, an aryl group or a heterocyclic group. Suitable examples of such an alkyl group include those containing 1 to 5 carbon atoms (e.g., methyl, ethyl, propyl, butyl), which may have a substituent group (e.g., sulfonic acid, carboxylic acid, hydroxyl). Suitable examples of such an aryl group include a phenyl group and a naphthyl group, which may be substituted with a sulfonic acid group, a carboxylic acid group, a hydroxyl group, a halogen atom (e.g., F, Cl, Br), an alkoxy group containing 1 to 5 carbon atoms (e.g., methoxy, ethoxy) or an amino group (e.g., dimethylamino, di-4-sulfobutylamino, dicarboxymethylamino). Suitable examples of such a heterocyclic group include residues of a pyridine ring, a 1,3-thiazole ring, a 1,3,4-triazole ring, a benzothiazole ring, a benzimidazole ring, a benzoxazole ring and a 1,2,4-thiadiazole ring, which may be substituted with a sulfonic acid group, a carboxylic acid group, hydroxyl group, methyl group, methoxy group, a halogen atom (e.g., F, Cl, Br), etc.

R in $SO_2R$, COR and CONHR represented by $R^2$ has the same meaning as described above. In addition, it is desirable that said R should contain an acidic substituent.

The term acidic substituent as used herein is intended to include a sulfonic acid group, a carboxylic acid group, a phosphonic acid group, $SO_2NHSO_2R$ and $CONHSO_2R$ (wherein R has the same meaning as described above). The term sulfonic acid group as used herein is intended to include sulfo group and salts thereof, the term carboxylic acid group as used herein is intended to include carboxyl group and salts thereof, and the term phosphonic acid group as used herein is intended to include phosphone group and salts thereof. Also, $SO_2NHSO_2R$ and $CONHSO_2R$ each may assume a salt form. Suitable examples of such salts include alkali metal salts such as that of Na or K, ammonium salt, and organic ammonium salts such as that of triethyl ammonium, tributyl ammonium, pyridinium, tetrabutyl ammonium, etc.

An alkyl group represented by $R^3$, $R^4$, $R^5$ and $R^6$ has the same meaning as described above. As for the amino group represented by $R^3$ and $R^4$, di-4-sulfobutylamino and dicarboxymethylamino groups can be given as examples. An alkoxy group represented by $R^3$ and $R^4$ is preferably one which contains 1 to 5 carbon atoms and may be substituted with a sulfonic acid group or a carboxylic acid group (e.g., 4-sulfobutoxy, carboxymethoxy).

An aryl group represented by $R^5$ and $R^6$ has the same meaning as described above, an acyl group represented thereby is, e.g., acetyl group or propionyl group, and a sulfonyl group represented thereby is, e.g., methanesulfonyl group or ethanesulfonyl group. In addition, $R^5$ and $R^6$ may combine with each other to complete a pyrrolidine, piperidine, morpholine or like ring.

Further, $R^5$ and $R^6$ may combine with $R^4$ present in the vicinity thereof to complete a julolidine, tetrahydroquinoline or like ring.

Moreover, it is essential for the dye molecule to contain at least three acidic substituents as described above.

In the general formula (IV-III), it is preferable that $R^1$ should be CONHR, wherein R represents an alkyl group, an aryl group or a heterocyclic group, $R^4$ should be hydrogen atom and $R^5$ and $R^6$ each should be an alkyl group, wherein every substituent group has the same meaning as described above.

Moreover, it is desirable that at least 4, preferably 5, acidi substituents should be contained in a dye molecule.

In particular, it is to be desired that at least 2 of the acidic substituents should be carboxylic acid groups.

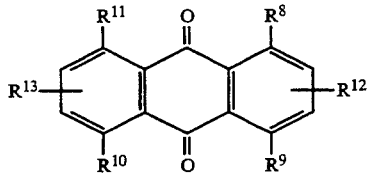

(V)

In the above formula, $R^8$, $R^9$, $R^{10}$ and $R^{11}$ may be the same or different, and each represents a hydrogen atom, a halogen atom (e.g., F, Cl, Br), a hydroxyl group, an amino group, an alkylamino group or an arylamino group; and $R^{12}$ and $R^{13}$ may be the same or different, each being a hydrogen atom, a halogen atom (e.g., F, Cl, Br) or a sulfonic acid group. Moreover, it is essential for the formula (V) that at least one of the groups represented by $R^8$, $R^9$, $R^{10}$, $R^{11}$, $R^{12}$ and $R^{13}$ should contain a sulfonic acid group as a substituent.

It is desirable that the alkyl moiety of the foregoing substituted or unsubstituted alkylamino group should contain 1 to 4 carbon atoms, and suitable examples of a substituent said moiety can have include sulfonic acid, hydroxyl and carboxyl groups. The aryl moiety of the foregoing substituted or unsubstituted arylamino group is preferably phenyl, and suitable examples of groups with which said phenyl moiety can be substituted include a 1–4C lower alkyl group, a1–4C lower alkoxy group, sulfonic acid group, carboxyl group, hydroxyl group, a halogen atom (e.g., F, Cl, Br) or an amino group (e.g., dimethylamino, ethylamino).

Of the dyes represented by the formula (V), those containing the following substituent groups are preferred over others. That is, $R^8$, $R^9$, $R^{10}$ or $R^{11}$, though these substituents may be the same or different, represents chlorine atom, hydroxyl group, a methylamino group substituted with sulfonic acid group or a phenylamino group substituted with sulfonic acid group, and $R^{12}$ or $R^{13}$, though these substituents may be the same or different, represents hydrogen atom, chlorine atom or a sulfonic acid group. In addition, it is essential for such dyes to contain at least two sulfonic acid groups in a molecule.

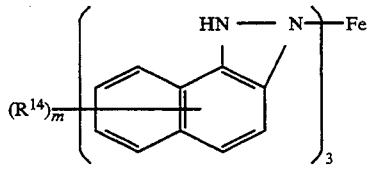

(VI)

In the above formula, $R^{14}$ represents a sulfonic acid group, and m represents an integer from 1 to 6, (preferably from 1 to 3).

It is more desirable that every dye molecule represented by the formula (VI) should contain two sulfonic acid groups.

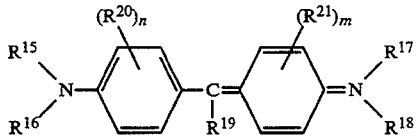

(VII)

In the above formula, $R^{15}$, $R^{16}$, $R^{17}$ and $R^{18}$ may be the same or different, and each represents an alkyl group, an aryl group, an acyl group or a sulfonyl group; $R^{19}$ represents an aryl group, a heterocyclic group or a cyano group; $R^{20}$ and $R^{21}$ may be the same or different, and each represents a hydrogen atom, a halogen atom, an alkyl group, a hydroxyl group, an alkoxy group, a sulfonic acid group, a carboxyl group or an amino group; and n and m each represent an integer from 1 to 4. Moreover, it is essential herein that at least one of the groups represented by $R^{15}$, $R^{16}$, $R^{17}$, $R^{18}$, $R^{19}$, $R^{20}$ and $R^{21}$ should contain a sulfonic acid group as a substituent.

Therein, the alkyl, aryl, acyl and sulfonyl groups represented by $R^{15}$, $R^{16}$, $R^{17}$ or $R^{18}$ have the same meanings as those represented by $R^{19}$ has the same meaning as that represented by $R^4$, and the heterocyclic group represented by $R^{19}$ may have a substituent group and may be monocyclic or condensed one. Examples of a substituent group the heterocyclic group can have include the same ones as cited in the description of the heterocyclic group represented by $R^7$.

The halogen atom, the alkyl group and the alkoxy group represented by $R^{20}$ and $R^{21}$ have the same meanings as those represented by $R^3$, respectively. The amino group represented by $R^{20}$ and $R^{21}$ may have a substituent group, and examples thereof include alkylamino and arylamino groups. As for these substituted amino groups, they have the same meanings as those represented by $R^8$. In addition, it is essential for the dye of the formula (VII) that at least one among $R^{15}$, $R^{16}$, $R^{17}$, $R^{18}$, $R^{19}$, $R^{20}$ and $R^{21}$ should contain a sulfonic acid group as a substituent.

It is preferred as the dyes of the formula (VII) that $R^{15}$, $R^{16}$, $R^{17}$ and $R^{18}$ each are an aryl or alkyl group, $R^{19}$ is an aryl group and $R^{20}$ and $R^{21}$ each are a sulfonic acid group (wherein the aryl and alkyl groups have the same meanings as described above, respectively).

(VIII)

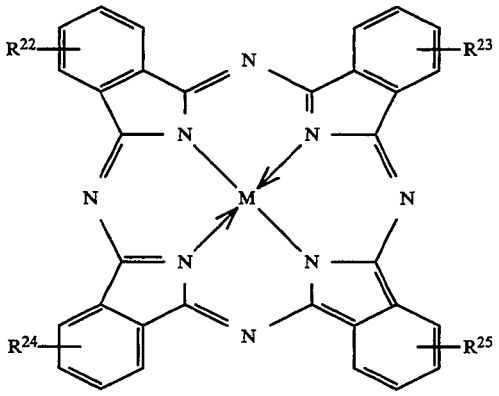

In the above formula, $R^{22}$, $R^{23}$, $R^{24}$ and $R^{25}$ may be the same or different, and each represents a hydrogen atom or a sulfonic acid group, and M represents a hydrogen atom or a metal atom. Moreover, it is essential for every dye represented by the formula (VIII) to contain at least two (preferably at least three) sulfonic acid groups.

As suitable examples of such a metal atom, mention may be made of Cu, Ni, Cr, Al, Fe, Zn, V, Ti and Si. Of these metals, Cu is preferred over others.

(IX)

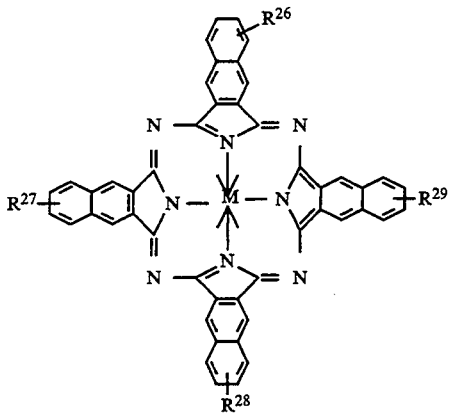

in the above formula, $R^{26}$, $R^{27}$, $R^{28}$ and $R^{29}$ may be the same or different, and each represents a hydrogen atom or a sulfonic acid group, and M represents a hydrogen atom or a metal atom (which has the same meaning as defined in the formula (VIII)). Moreover, it is essential for every dye represented by the formula (IX) to contain at least two (preferably three) sulfonic acid groups. As for the metal atom, Cu is preferred.

(X)

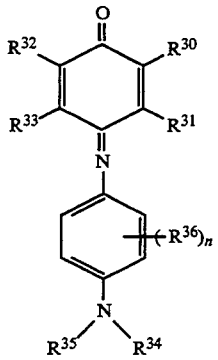

In the above formula, $R^{30}$ represents a hydrogen atom, a halogen atom or a group represented by $CONHR^{37}$, $NHCOR^{37}$, $COR^{37}$, $CO_2R^{37}$, $NHCONHR^{37}$ or $NHSO_2R^{37}$, wherein $R^{37}$ represents an alkyl group, an aryl group or a heterocyclic group; and $R^{31}$, $R^{32}$ and $R^{33}$ may be the same or different, and each represents a hydrogen atom, a halogen atom, an alkyl group or a group represented by $NHCOR^{37}$, $NHCONHR^{37}$ or $NHSO_2R^{37}$, wherein $R^{37}$ has the same meaning as described above, or a combination of $R^{32}$ with $R^{33}$ completes a 5- or 6-membered ring (e.g., pyrrolidine, cyclohexene). $R^{34}$ and $R^{35}$ may be the same or different, and each represents an alkyl group, an aryl group, an acyl group (e.g., acetyl, propionyl) or a sulfonyl group (e.g., methanesulfonyl, ethanesulfonyl), or each combines with the other or $R^{36}$ to complete a 5- or 6-membered ring. $R^{36}$ represents a hydrogen atom, a halogen atom, an alkyl group, a hydroxyl group, an alkoxy group (e.g., methoxy, ethoxy, 2-sulfoethoxy, methoxyethoxy) or a group represented by $NHCOR^{37}$, $NHSO_2R^{37}$ or $NHCONHR^{37}$, wherein $R^{37}$ has the same meaning as described above, and n represents an integer from 1 to 4. Moreover, it is essential in the formula (X) that at least one of the groups represented by $R^{30}$, $R^{31}$, $R^{32}$, $R^{33}$, $R^{34}$, $R^{35}$ and $R^{36}$ should contain a sulfonic acid group as a substituent.

The halogen atom represented by $R^{30}$, $R^{31}$, $R^{32}$, $R^{33}$ or $R^{36}$ includes F, Cl, Br and the like.

The alkyl, aryl or heterocyclic group represented by $R^{37}$ has the same meaning as those represented by $R^7$, respectively.

The alkyl group represented by $R^{31}$, $R^{32}$, $R^{33}$, $R^{34}$, $R^{35}$ or $R^{36}$ and the aryl group represented by $R^{34}$ or $R^{35}$ have the same meanings as those represented by $R^2$, respectively.

It is more desirable that $R^{30}$ should be $NHCOR^{37}$ or $NHSO_2R^{37}$, wherein $R^{37}$ has the same meaning as described above, $R^{31}$ should be a hydrogen atom, $R^{32}$ should be a hydrogen atom, a halogen atom (e.g., Cl or Br) or an alkyl group (as defined above), $R^{33}$ should be an alkyl group 9as defined above), $NHCOR^{37}$ or $NHSO_2R^{37}$, wherein $R^{37}$ has the same meaning as described above, $R^{34}$ and $R^{35}$ each should be an unsubstituted or sulfo-substituted alkyl group (as defined above), $R^{36}$ should be an alkyl group (as defined above), an alkoxy group (as defined above) or $NHCOR^{37}$, wherein $R^{37}$ has the same meaning as described above, and n should be 1. In addition, it is essential for such a dye molecule also to contain at least two sulfonic acid groups.

Sulfonic acid and carboxyl groups present in the general formulae from (IV) to (X) may assume the form of salt. Suitable examples of such salts include those of alkali metals such as sodium and potassium, those of alkaline earth metals such as calcium, ammonium salt, organic ammonium salts such as triethylamine, tributylamine and pyridine salts, and inner salts.

Specific examples of water-soluble dyes represented by the general formulae from (IV) to (X) are illustrated below. However, the invention should not be construed as being limited to these examples.

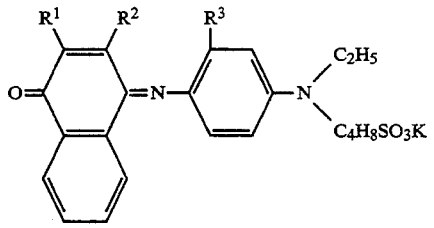

| | $R^1$ | $R^2$ | $R^3$ |
|---|---|---|---|
| IV-1 | $CONHCH_2CH_2SO_3K$ | H | $CH_3$ |
| IV-2 | 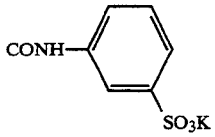 | H | $CH_3$ |
| IV-3 | 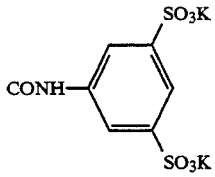 | H | $CH_3$ |
| IV-4 | 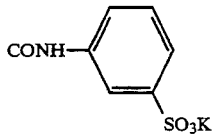 | $CH_3$ | $CH_3$ |
| IV-5 | $CONHCH_2CH_2SO_3K$ | 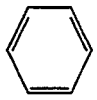 | $CH_3$ |
| IV-6 | 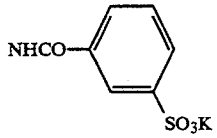 | H | $NHCOCH_3$ |
| IV-7 | 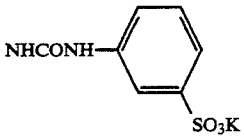 | H | $OC_4H_9SO_3K$ |

-continued
| | | | |
|---|---|---|---|
| IV-8 | 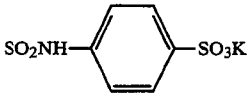 | H | 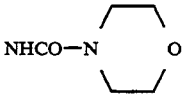 |
| IV-9 | 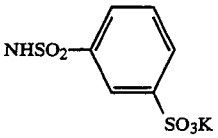 | H | OH |
| IV-10 | 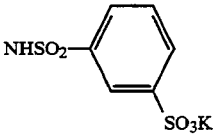 | H | $NHCONHCH_3$ |
IV-11
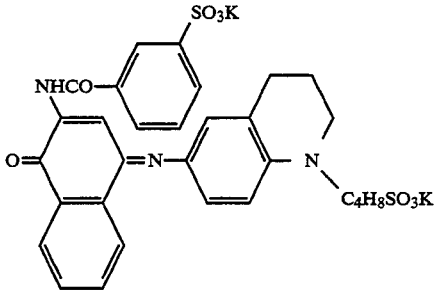
IV-12
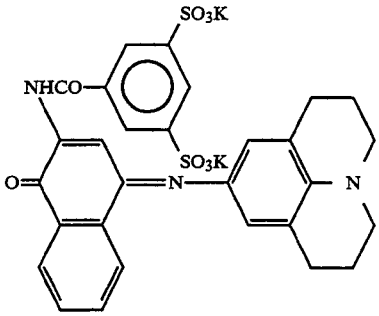
IV-13
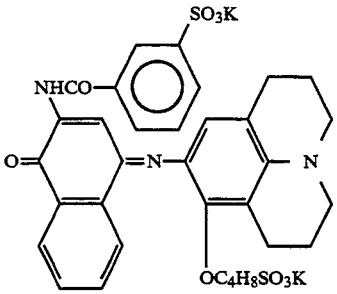

-continued
IV-14
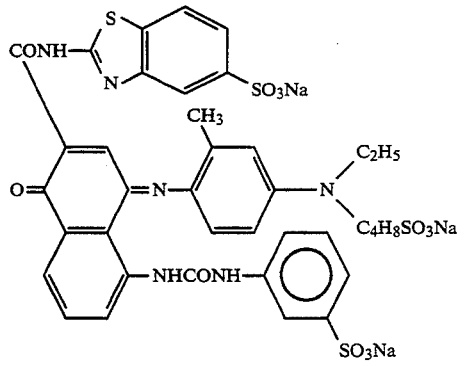
IV-15
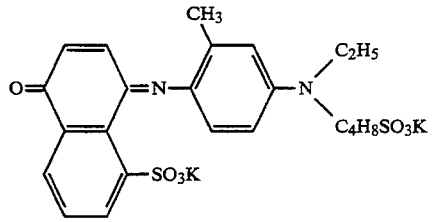
IV-16
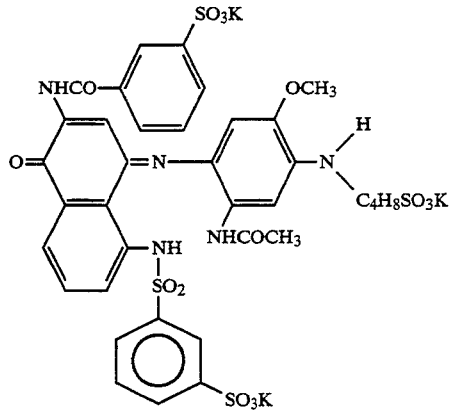
IV-17
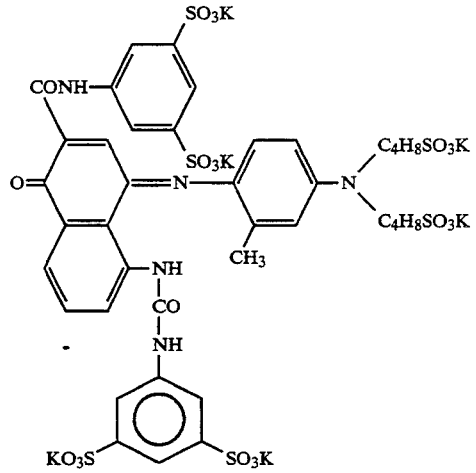

-continued
IV-18
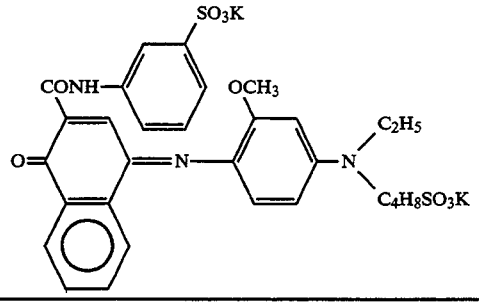
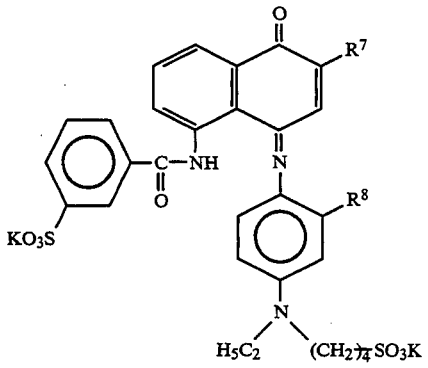
| | $R^7$ | $R^8$ |
|---|---|---|
| IV-19 | 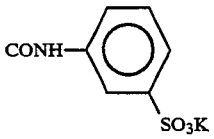 | $OCH_3$ |
| IV-20 | 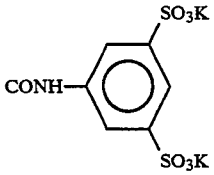 | $OCH_3$ |
| IV-21 | " | $CH_3$ |
| IV-22 | " | $NHCOCH_3$ |
| IV-23 | " | H |
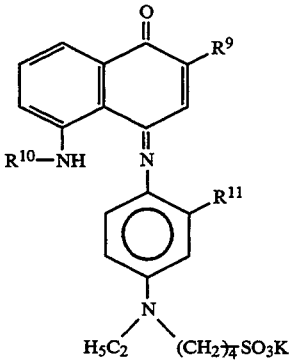
| | $R^9$ | $R^{10}$ | $R^{11}$ |
|---|---|---|---|
| IV-24 | 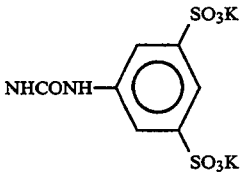 | 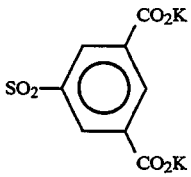 | $OCH_3$ |

-continued
| | | | |
|---|---|---|---|
| IV-25 | 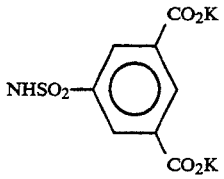 | " | " |
| IV-26 | 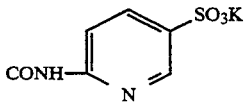 | 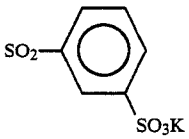 | $OCH_3$ |
| IV-27 | $SO_3K$ | " | $O(CH_2)_4SO_3K$ |
| IV-28 | $CO_2K$ | " | " |
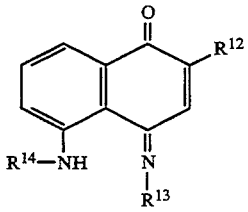
| | $R^{12}$ | $R^{13}$ | $R^{14}$ |
|---|---|---|---|
| IV-29 | $CONH(CH_2)_2SO_3K$ | 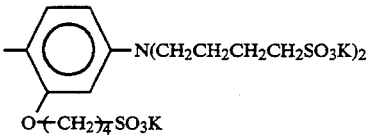 | 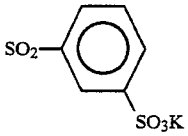 |
| IV-30 | 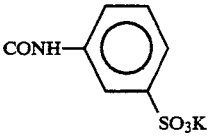 | 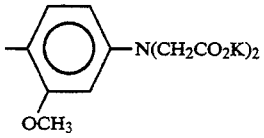 | 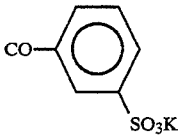 |
| IV-31 | " | 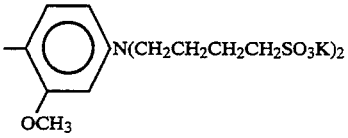 | $SO_2CH_3$ |
| IV-32 | " | " | 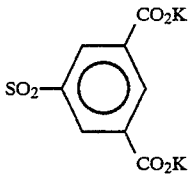 |
| IV-33 | " | " | 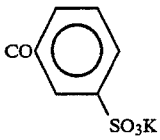 |
| IV-34 | 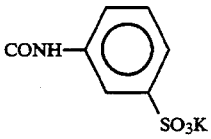 | 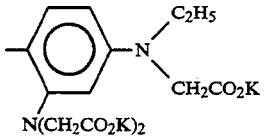 | $SO_2CH_3$ |

-continued
| | | | |
|---|---|---|---|
| IV-35 | 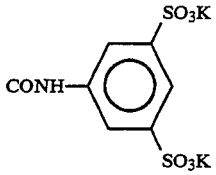 | 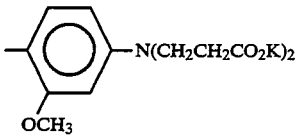 | $SO_2CF_3$ |
| IV-36 | 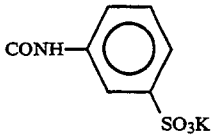 | 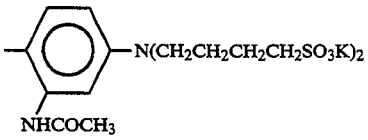 | 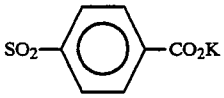 |
| IV-37 | 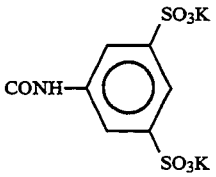 | 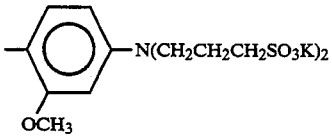 | 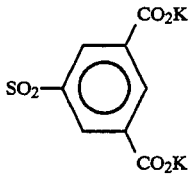 |
| IV-38 | 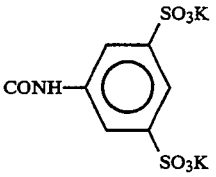 | " | 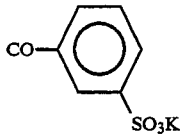 |
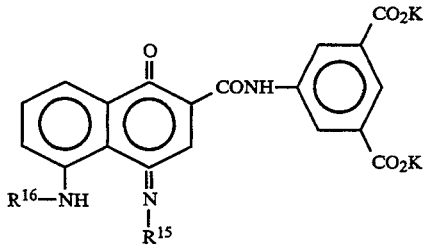
| | $R^{15}$ | $R^{16}$ |
|---|---|---|
| IV-39 | 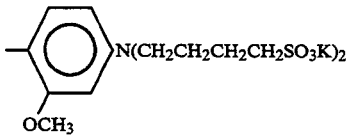 | 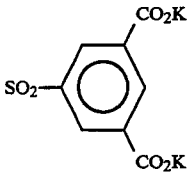 |
| IV-40 | " | 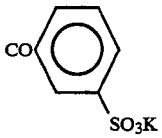 |
| IV-41 | " | 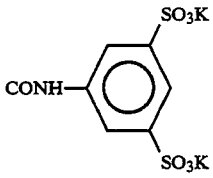 |
| IV-42 | " | $CH_2SO_3K$ |

-continued
IV-43
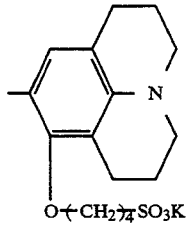
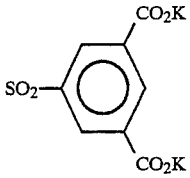
IV-44
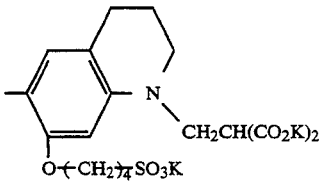
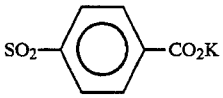
IV-45
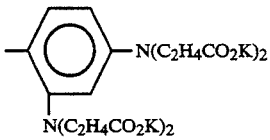
"
IV-46
"
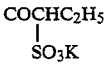
IV-47
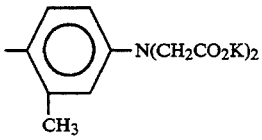
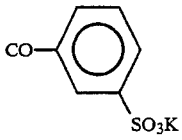
IV-48
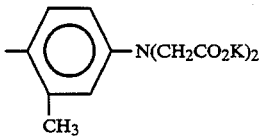
"
IV-49
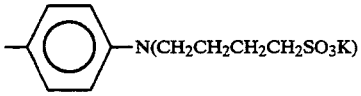
"
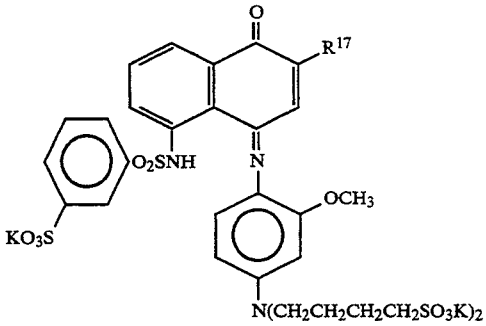
$R^{17}$
IV-50
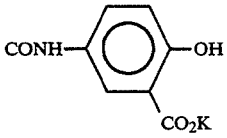

-continued
IV-51
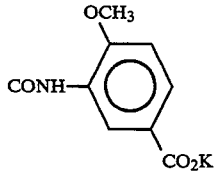
IV-52
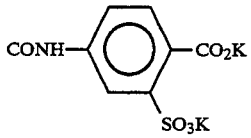
IV-53
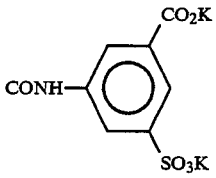
IV-54
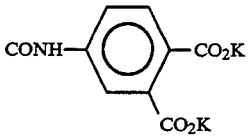
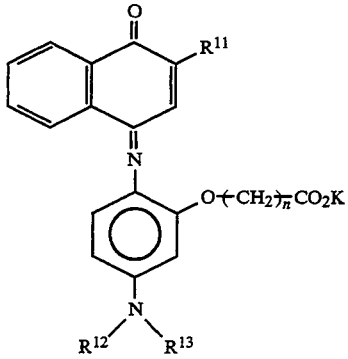
| | $R^{11}$ | $R^{12}$ | $R^{13}$ | n |
|---|---|---|---|---|
| IV-55 | 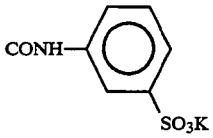 | $C_2H_5$ | $(CH_2)_4SO_3K$ | 1 |
| IV-56 | 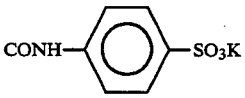 | $C_2H_5$ | $CH_2CO_2K$ | 1 |
| IV-57 | 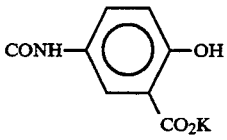 | $C_2H_5$ | $(CH_2)_3SO_3K$ | 1 |
| IV-58 | 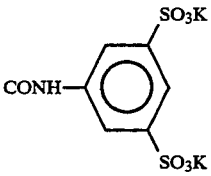 | $C_2H_5$ | $CH_2CO_2K$ | 1 |

-continued

| | | | | |
|---|---|---|---|---|
| IV-59 | 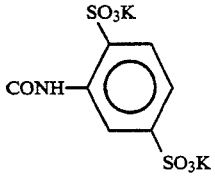 | $C_2H_5$ | $CH_2CO_2K$ | 1 |
| IV-60 | $CONHCH_2CH_2SO_3K$ | $\leftarrow CH_2 \rightarrow_4 SO_3K$ | $\leftarrow CH_2 \rightarrow_4 SO_3K$ | 2 |
| IV-61 | 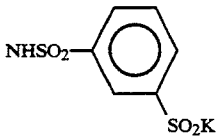 | $C_2H_5$ | $\leftarrow CH_2 \rightarrow_4 SO_3K$ | 2 |
| IV-62 | 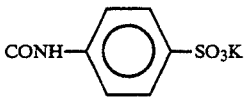 | $\leftarrow CH_2 \rightarrow_4 SO_3K$ | $\leftarrow CH_2 \rightarrow_4 SO_3K$ | 1 |
| IV-63 | 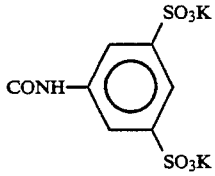 | $\leftarrow CH_2 \rightarrow_4 SO_3K$ | $\leftarrow CH_2 \rightarrow_4 SO_3K$ | 1 |
| IV-64 | " | $C_2H_5$ | $\leftarrow CH_2 \rightarrow_4 SO_3K$ | 1 |

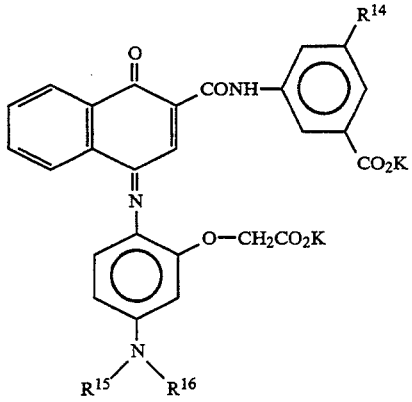

| | $R^{14}$ | $R^{15}$ | $R^{16}$ |
|---|---|---|---|
| IV-65 | H | $C_2H_5$ | $\leftarrow CH_2 \rightarrow_4 SO_3K$ |
| IV-66 | H | $\leftarrow CH_2 \rightarrow_4 SO_3K$ | $\leftarrow CH_2 \rightarrow_4 SO_3K$ |
| IV-67 | $CO_2K$ | " | " |
| IV-68 | " | $C_2H_5$ | " |
| IV-69 | " | $CH_2CO_2K$ | $CH_2CO_2K$ |
| IV-70 | " | $C_2H_5$ | " |
| IV-71 | " | $\leftarrow CH_2 \rightarrow_4 SO_3K$ | $\leftarrow CH_2 \rightarrow_4 SO_3K$ |

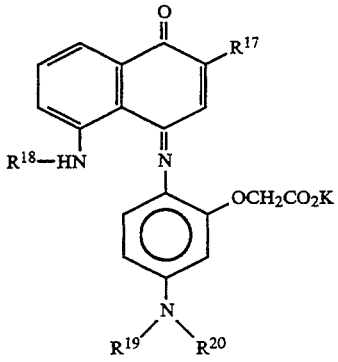

-continued

| | $R^{17}$ | $R^{18}$ | $R^{19}$ | $R^{20}$ |
|---|---|---|---|---|
| IV-72 | $CONHCH_2CH_2SO_3K$ | 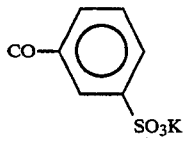 | $C_2H_5$ | $\leftarrow CH_2 \rightarrow_4 SO_3K$ |
| IV-73 | 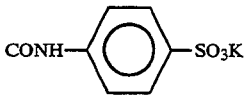 | " | $\leftarrow CH_2 \rightarrow_4 SO_3K$ | $\leftarrow CH_2 \rightarrow_4 SO_3K$ |
| IV-74 | 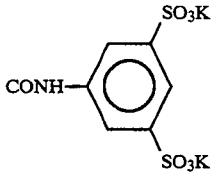 | " | $CH_2CO_2K$ | $CH_2CO_2K$ |
| IV-75 | " | 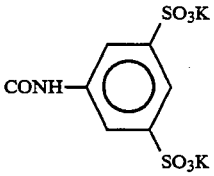 | $\leftarrow CH_2 \rightarrow_4 SO_3K$ | $\leftarrow CH_2 \rightarrow_4 SO_3K$ |
| IV-76 | " | 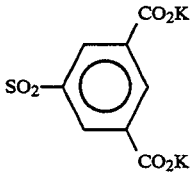 | " | " |
| IV-77 | 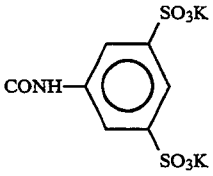 | 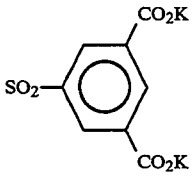 | $CH_2CO_2K$ | $CH_2CO_2K$ |
| IV-78 | 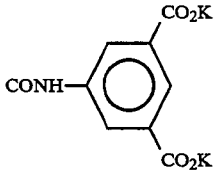 | " | " | " |
| IV-79 | " | 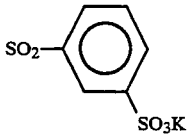 | $C_2H_5$ | $\leftarrow CH_2 \rightarrow_4 SO_3K$ |
| IV-80 | " | 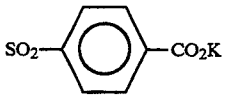 | " | $CH_2CO_2K$ |
| IV-81 | " | 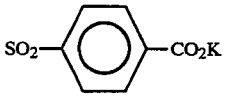 | " | $\leftarrow CH_2 \rightarrow_4 SO_3K$ |

-continued
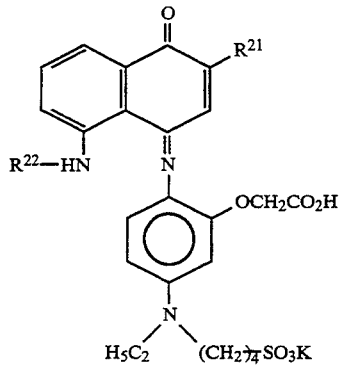
| | $R^{21}$ | $R^{22}$ |
|---|---|---|
| IV-82 | 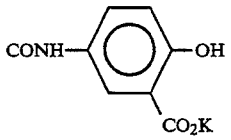 | 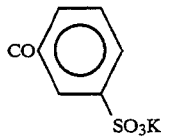 |
| IV-83 | 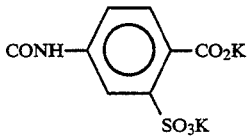 | 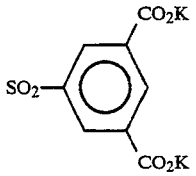 |
| IV-84 | 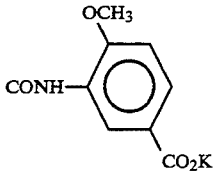 | 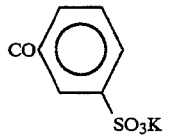 |
| IV-85 | 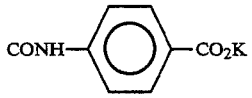 | " |
IV-86
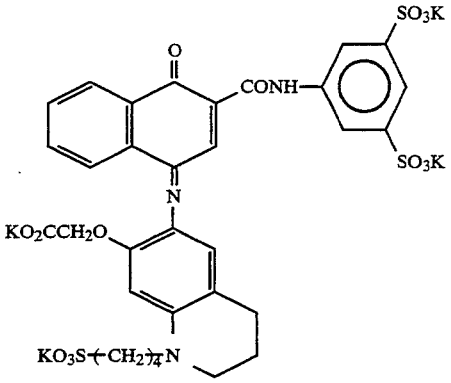

-continued
IV-87
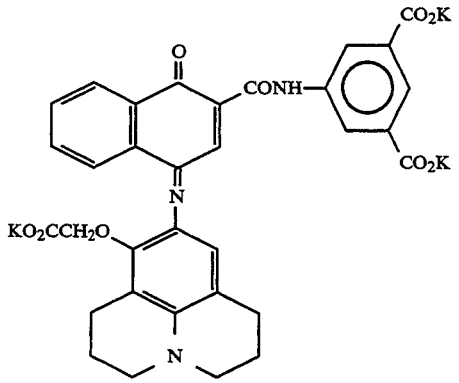
IV-88
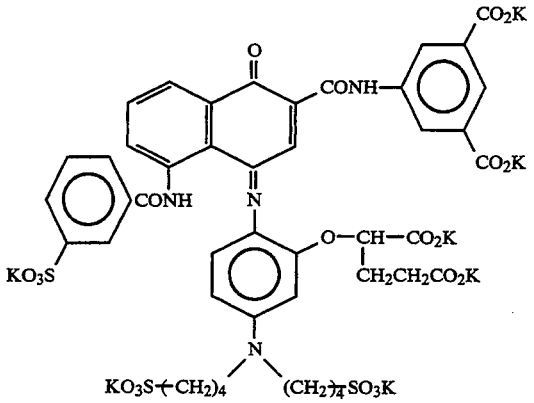
IV-89
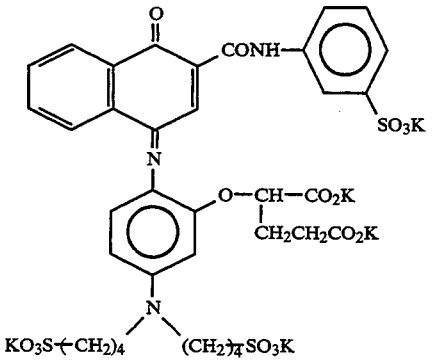
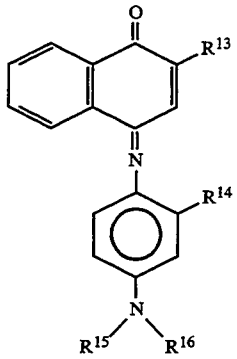
| $R^{13}$ | $R^{14}$ | $R^{15}$=$R^{16}$ |
|---|---|---|

-continued

| | | | |
|---|---|---|---|
| IV-90 | 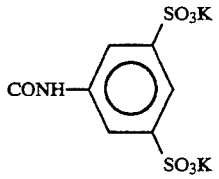 | $O\leftarrow CH_2\rightarrow_4 SO_3K$ | $O\leftarrow CH_2\rightarrow_4 SO_3K$ |
| IV-91 | 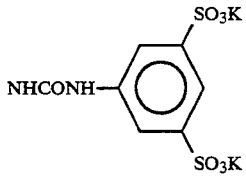 | $O\leftarrow CH_2\rightarrow_4 SO_3K$ | $O\leftarrow CH_2\rightarrow_4 SO_3K$ |
| IV-92 | 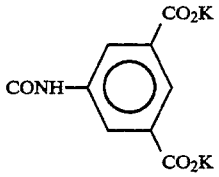 | $O\leftarrow CH_2\rightarrow_4 SO_3K$ | $O\leftarrow CH_2\rightarrow_4 SO_3K$ |
| IV-93 | 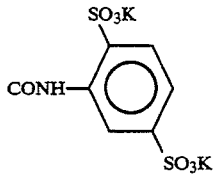 | $O\leftarrow CH_2\rightarrow_4 SO_3K$ | $O\leftarrow CH_2\rightarrow_4 SO_3K$ |
| IV-94 | 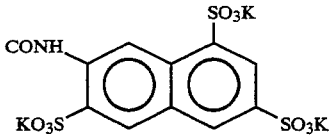 | $OCH_3$ | $O\leftarrow CH_2\rightarrow_2 CO_2K$ |
| IV-95 | 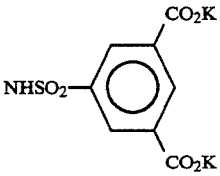 | $O\leftarrow CH_2\rightarrow_4 SO_3K$ | $O\leftarrow CH_2\rightarrow_4 SO_3K$ |
| IV-96 | 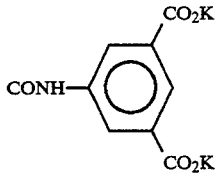 | $O\leftarrow CH_2\rightarrow_3 SO_3K$ | $\leftarrow CH_2\rightarrow_3 SO_3K$ |
| IV-97 | 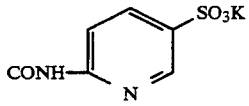 | $N(CH_2CH_2CH_2CH_2SO_3K)_2$ | $\leftarrow CH_2\rightarrow_4 SO_3K$ |
| IV-98 | 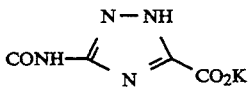 | $N(CH_2CO_2K)_2$ | $CH_2CO_2K$ |
| IV-99 | $CO_2K$ | $N(CH_2CH_2CH_2SO_3K)_2$ | $\leftarrow CH_2\rightarrow_3 SO_3K$ |

-continued
IV-100
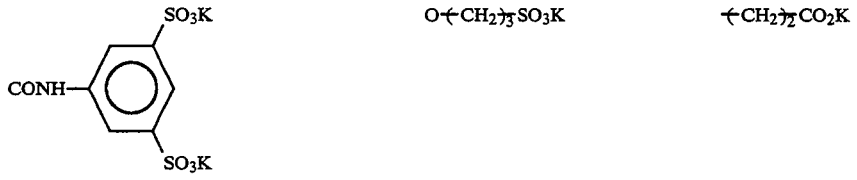
IV-101 $SO_3K$ $N(CH_2CH_2CH_2SO_3K)_2$ $(CH_2)_3SO_3K$
IV-102
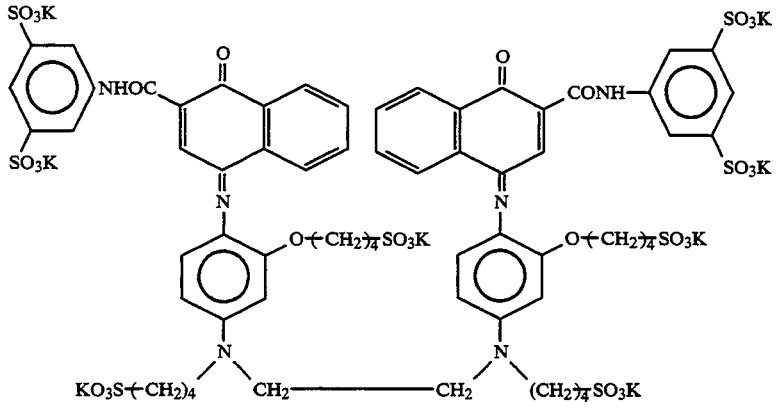
IV-103
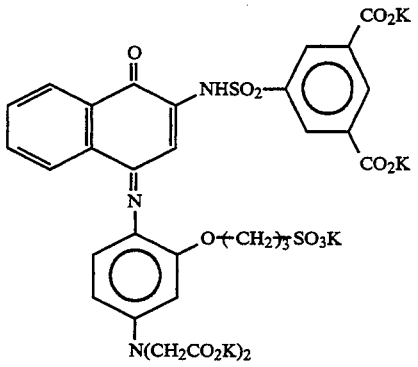
IV-104
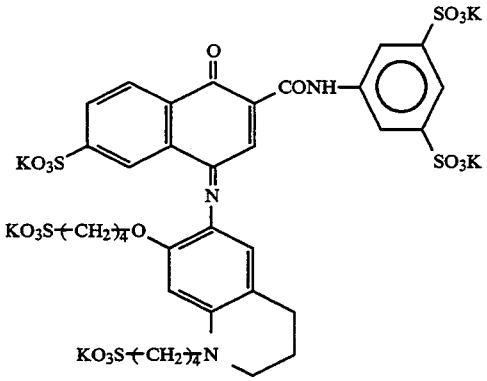

-continued
IV-105
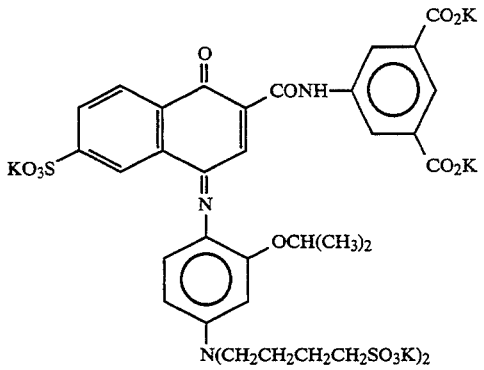
IV-106
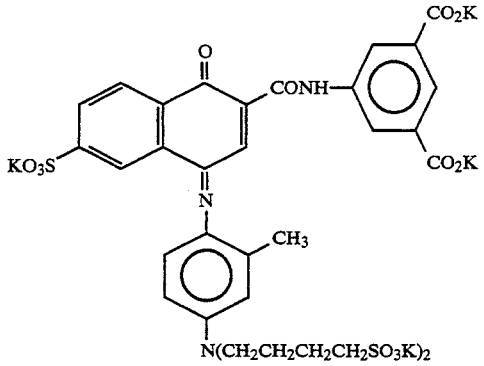
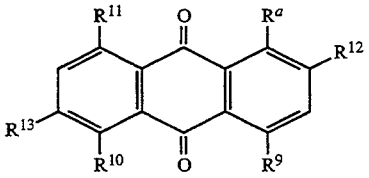
| | $R^8$ | $R^9$ | $R^{10}$ | $R^{11}$ | $R^{12}$ | $R^{13}$ |
|---|---|---|---|---|---|---|
| V-1 | 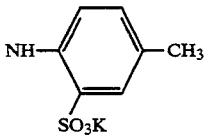 | 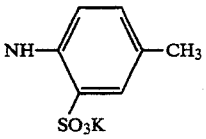 | H | H | H | |
| V-2 | 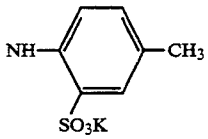 | 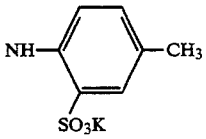 | OH | OH | H | |
| V-3 | OH | $NHCH_2SO_3Na$ | OH | $NHCH_2SO_3Na$ | $SO_3Na$ | |
| V-4 | $NH_2$ | 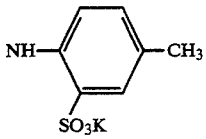 | $NH_2$ | 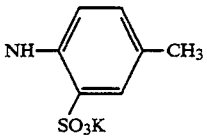 | Cl | |
| V-5 | $NHCH_2SO_3K$ | 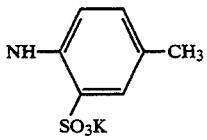 | $NHCH_2SO_3K$ | 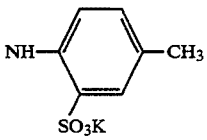 | Cl | |

-continued
| | | | | | |
|---|---|---|---|---|---|
| V-6 | 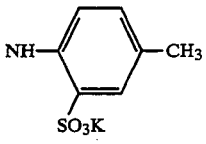 | 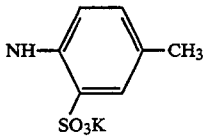 | 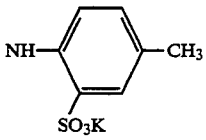 | 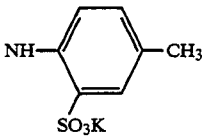 | H |
| V-7 | $NHCH_2SO_3K$ | 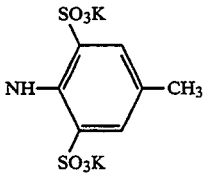 | $NHCH_2SO_3K$ | 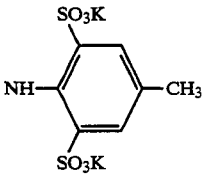 | Cl |
| V-8 | 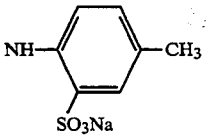 | Cl | 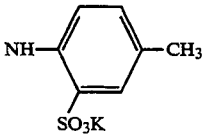 | Cl | H |
VI-1
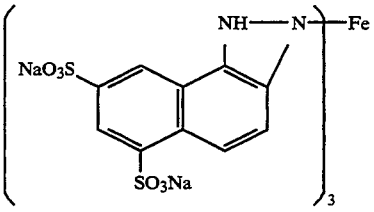
VI-2
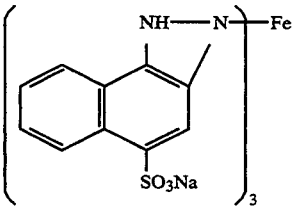
VI-3
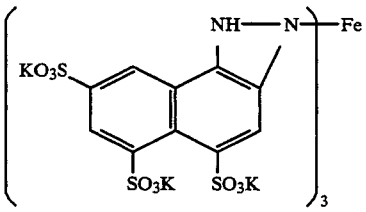
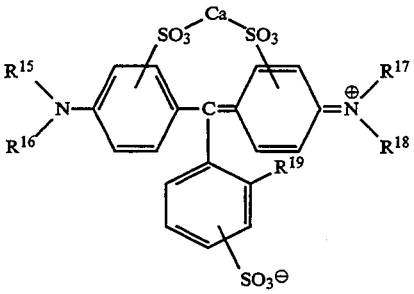
| | $R^{15}$ | $R^{16}$ | $R^{17}$ | $R^{18}$ | $R^{19}$ |
|---|---|---|---|---|---|
| VII-1 | $CH_3$ | $CH_3$ | $CH_3$ | $CH_3$ | H |
| VII-2 | $CH_3$ | $CH_3$ | $CH_3$ | $CH_3$ | Cl |
| VII-3 | $CH_3$ | $C_4H_8SO_3K$ | $CH_3$ | $C_4H_8SO_3K$ | Cl |

-continued
| | | | | | |
|---|---|---|---|---|---|
| VII-4 | $CH_3$ | 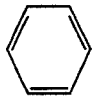 | $CH_3$ | 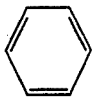 | Cl |
| VII-5 | $C_4H_8SO_3K$ | 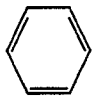 | $C_4H_8SO_3K$ | 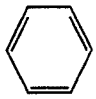 | Cl |
VII-6
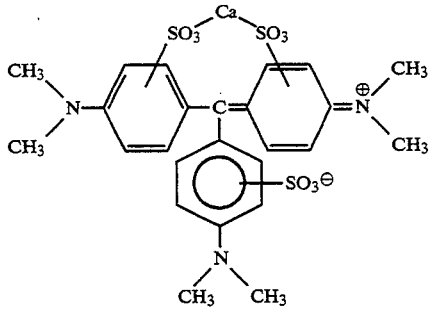
VII-7
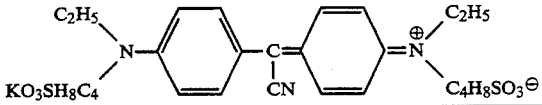
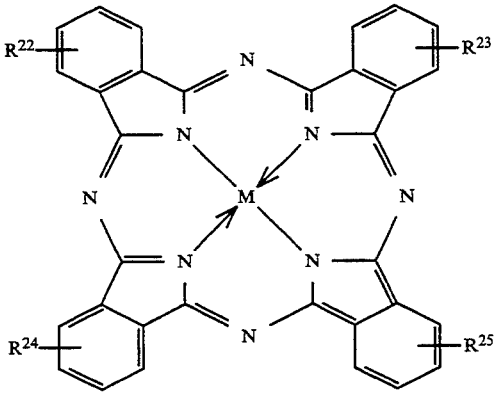
| | $R^{22}$ | $R^{23}$ | $R^{24}$ | $R^{25}$ | M |
|---|---|---|---|---|---|
| VIII-1 | $SO_3Na$ | $SO_3Na$ | $SO_3Na$ | H | Cu |
| VIII-2 | $SO_3Na$ | $SO_3Na$ | $SO_3Na$ | $SO_3Na$ | H |
| VIII-3 | $SO_3K$ | $SO_3K$ | $SO_3K$ | H | V |
| VIII-4 | $SO_3K$ | H | $SO_3K$ | H | Ni |
| VIII-5 | $SO_3Na$ | $SO_3Na$ | $SO_3Na$ | $SO_3Na$ | Ti |
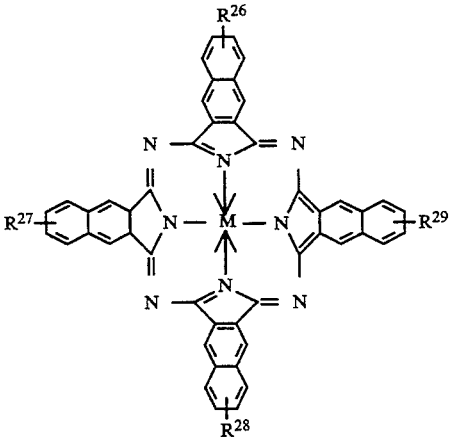
| | $R^{26}$ | $R^{27}$ | $R^{28}$ | $R^{29}$ | M |
|---|---|---|---|---|---|

-continued
| | | | | | |
|---|---|---|---|---|---|
| IX-1 | $SO_3Na$ | $SO_3Na$ | $SO_3Na$ | $SO_3Na$ | Cu |
| IX-2 | $SO_3Na$ | $SO_3Na$ | $SO_3Na$ | H | V |
| IX-3 | $SO_3Na$ | $SO_3Na$ | $SO_3Na$ | $SO_3Na$ | Zn |
| IX-4 | $SO_3Na$ | $SO_3Na$ | $SO_3Na$ | $SO_3Na$ | H |
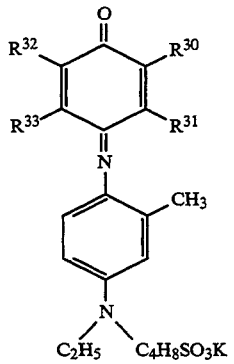
| | $R^{30}$ | $R^{31}$ | $R^{32}$ | $R^{33}$ |
|---|---|---|---|---|
| X-1 | 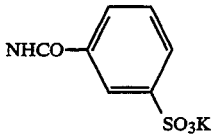 | H | Cl | $C_2H_5$ |
| X-2 | 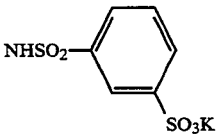 | H | Cl | $C_2H_5$ |
| X-3 | 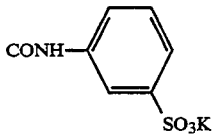 | H | H | 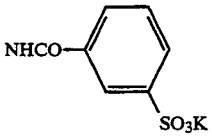 |
| X-4 | 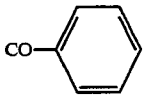 | H | H | 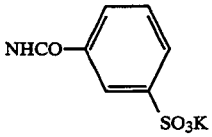 |
| X-5 | Cl | H | H | Cl |
| X-6 | 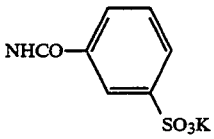 | $CH_3$ | H | H |
| X-7 | 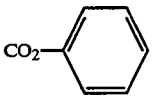 | H | H | 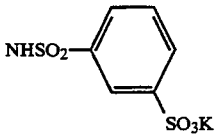 |

-continued
X-8
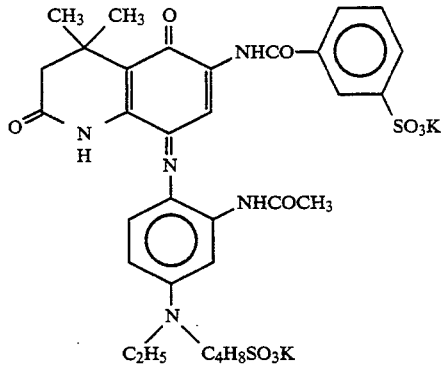
X-9
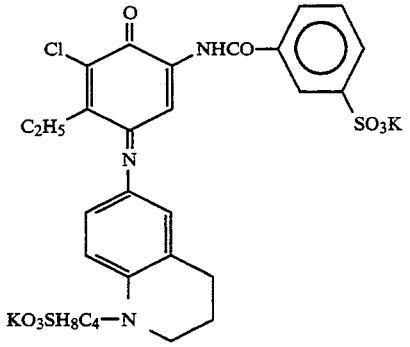
X-10
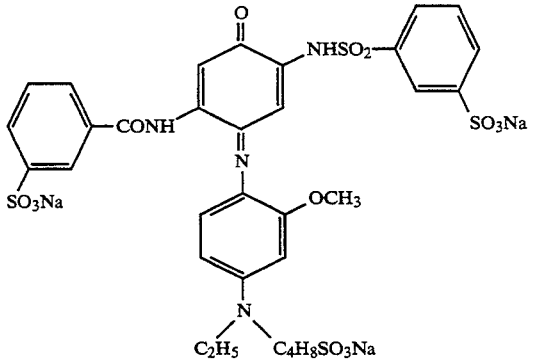
(X-11)
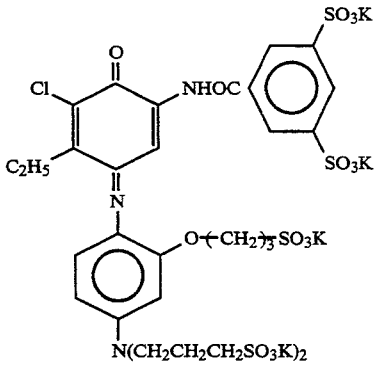

-continued (X-12)

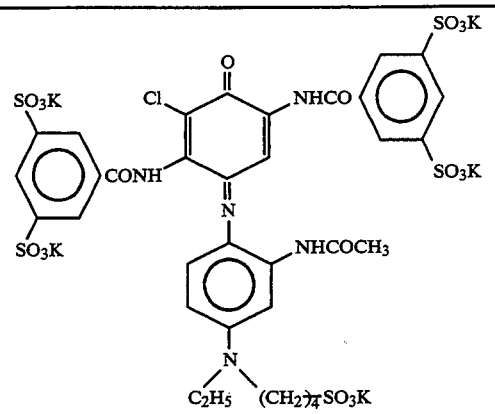

These dyes can be synthesized with ease by reference to JP-A-62-3250, a book entitled 'Senryo Kagaku' (which means "chemistry of dyes") written by Yutaka Hosoda (published by Gihodo), U.S. Pat. Nos. 3,177,078 and 3,738,846, British patent 1,226,562, and so on.

In addition to the dyes given above as specific examples, dyes which can be used appropriately include arylidene dyes described in JP-A-64-42646 and U.S. Pat. No. 4,102,688; anthraquinone dyes described in U.S. Pat. No. 3,575,704; triarylmethane dyes described in JP-B-03-26813 (The term "JP-B" as used herein means an "examined Japanese publication); indoaniline dyes described in JP-A-62-3250, JP-A-02-259753 and JP-A-01-99040; azomethine dyes described in JP-A-02-165134, JP-A-02-181747 and JP-A-02-165133; tetraarylpolymethine dyes described in JP-A-02-216140; copper phthalocyanine dyes described in British Patent 1,226,562 and JP-A-01-138553; 1,2-diaminonaphthalenesulfonatoiron complex dyes described in U.S. Pat. No. 3,177,078; azo dyes described in U.S. Pat. No. 4,395,544, JP-A-51-104342, *J. Chem. Soc.*, Chem. Commun., 1639–1640 (1986); metal-containing indoaniline dyes described in JP-A-01-121851 and JP-A-01-253734; imonium dyes described in J. Griffiths, *Colour and Constitution of Organic Molecules*, Academic Press, London (1976); and so on. The dyes described in those references can be used as they are, or after introduction of proper substituents (e.g., sulfo, carboxyl, etc.) thereinto, if needed.

It is essential for the present invention to incorporate at least one water-soluble dye as described above into the photographic materials defined in the present invention. It is necessary for these water soluble dyes to elute from the photographic materials or to undergo decoloration in the course of development processing. It is required of the water-soluble dyes to contain at least one kind of water-soluble groups and, more specifically, to have such solubility 8in water that they can be dissolved in a quantity of at least 0.2 g, preferably at least 0.5 g, in 100 ml of water (at 25° C.). The dyes added to a colloid layer not only stay inside that layer but also uniformly diffuse outward during coating operation, resulting in their spreading throughout the photographic material. Accordingly, the use of dyes specified in the present invention is different essentially from the use of nondiffusible dyes in a filter layer as disclosed in U.S. Pat. No. 4,619,892 in respects of the end-use purpose and characteristics ensured thereby. In other words, the water-soluble dyes of the present invention are used for the purpose of cutting down the irradiation light in the photographic material to heighten the resolution. Since the dyes of the present invention are distributed uniformly throughout the photographic material and, what is more, not only light coming in the photographic material from the surface but also light reflected from the support contributes greatly to the sensitivity when the photographic material has a reflecting support, sensitivity reduction caused by the dyes in one light-sensitive layer is, in general, almost equivalent in extent to that in every other light-sensitive layer, irrespective of the arranging order of the light-sensitive layers. Consequently, color separation does not improve by the presence of water-soluble dyes in the photographic material, in analogy with the absence thereof. On the other hand, the filter layer comprising a nondiffusible dye used in U.S. Pat. No. 4,619,892 is provided for the purpose of making an improvement on color separation by preventing the rays of light used for exposure of the upper layer from reaching the lower layer, compared with the case in which any filter layer is not provided. Therefore, it is necessary for a dye fixed between two light-sensitive layers to have such a property that it can effectively absorb light at the wavelengths which light used for exposure of the upper layer has, but to the least possible extent it absorbs light used for exposure of the lower layer. In addition, from the standpoint of the distribution of spectral sensitivities created by spectral sensitizing dyes, it is indispensable to the light-sensitive layers having a filter layer therebetween that the upper layer should have its spectral sensitivity maximum at a wavelength shorter than the lower layer. In contrast to such a case, the present invention can be adopted in both spectral sensitivity relationships between the upper and the lower layers, whether or not the upper layer has its spectral sensitivities at wavelengths shorter than the lower layer.

As mentioned above, water-soluble dyes have no contribution to an improvement on color separation. On the contrary, they aggravate it in some cases. A special feature of the present invention consists in controlling the aggravation of color separation due to water-soluble dyes to the slightest possible extent.

In introduction into the photographic materials, the water-soluble dyes used in the present invention are added to a coating composition in the form of aqueous solution. Also, these dyes may be dissolved in a mixture of water and an organic solvent (e.g., methanol), and then added to a coating composition.

The foregoing dyes of the present invention may be used alone or as a mixture, and they are preferably added in such an amount (a total amount in case of the mixture) that the photographic material containing said dye(s) may have a reflectance of at most 50%, particularly at most 30%, when measured at the wavelengths of laser beams used for the exposure of the photographic material of the present invention. The grater the amount of the dye(s) used is, the more the sharpness of images is heightened, while the more serious the drop in sensitivity becomes, and so the upper limit of the amount of the dye(s) is determined so as to adjust a proper balance between the sensitivity and sharpness.

The above-described reflectance can be calculated by determining a ratio of the intensity of reflected light to that of incident light through the measurement of absorption spectrum of reflected light with a spectrophotometer equipped with an integrating sphere.

It is desirable for heightening spectral sensitivities in the infrared region and stability that silver halide emulsions used in the present invention should comprise silver halide grains as described in JP-A-03-84545, which have a high chloride content and contain 0.01–3 mol % of iodide at the grain surface. For the purpose of reducing a development time, on the other hand, emulsions comprising substantially iodide-free silver chlorobromide grains or silver chloride grains are preferably used. The expression "substantially iodide-free" as used herein means that an iodide content is below 1 mol %, preferably below 0.2 mol %. Emulsion grains which constitute every emulsion may differ or the same in halide composition. When an emulsion is constituted by grains having the same halide composition, it is ease to render all the grains uniform in quality. As for the halide composition distribution inside the emulsion grains each, it can assume any structure. For instance, it may be selected properly from a so-called uniform structure in which each grain is uniform throughout in halide composition, a so-called layer structure in which inner part (core) of each grain is different in halide composition from the part surrounding it (shell made up of one or more layers), or such a structure that the interior or surface of each grain has part differing in halide composition from the surroundings thereof in a nonlayer form (e.g., such a structure that said part is fused together with the grain proper at the edge, corner or face when it is present on the grain surface). For the purpose of achieving high sensitivity, grains having either of the latter two structures are of greater advantage than grains having a uniform structure. In respect of pressure resistance also, it is preferable that grains should take either of the latter two structures. At the interface between parts differing in halide composition, a definite boundary may be formed, or mixed crystals may be formed depending on the difference in composition to render the boundary obscure, or a continuous change in structure may be introduced positively.

Further, so-called high-chloride emulsions, or silver halide emulsions having a high chloride content, are used to advantage in photographic materials suitable for rapid processing. A chloride content in high-chloride emulsions used in the present invention is preferably at least 95 mol %, more preferably at least 97 mol %.

Also, it is desirable that the high-chloride emulsions should have a bromide-localized phase inside or at the surface of every emulsion grain in such a layer or nonlayer form as described above.

A preferred halide composition in said localized phase is at least 10 mol % in bromide content, especially more than 20 mol % in bromide content. The localized phase may be present inside every emulsion grain, or on the edge, corner or face part of the grain surface. As a preferred example, however, there can be given such a structure that the localized phase is formed on corners of the grain surface through the epitaxial growth.

For the purpose of reduction of a developing solution in amount replenished, it is also effective to further heighten a chloride content in the silver halide emulsions to be processed therein. In such a case, emulsion grains constituted almost entirely by silver chloride, that is, having a chloride content of from 98 to 100 mol %, can be used to advantage.

An average size of the silver halide grains contained in the silver halide emulsions used in the present invention (which is obtained by determining diameters of circles equivalent to projected areas of grains and taking a number average thereof) ranges preferably from 0.1 to 2 μm.

As for the distribution of sizes among emulsion grains, so-called monodisperse emulsions having a variation coefficient (which is obtained by dividing a standard deviation of the grain size distribution by an average grain size) of at most 20%, preferably at most 15%, are preferred. For the purpose of attaining a wide latitude, it is desirable that at least two monodisperse emulsions may be used in one layer as a blend, or in at least two layers separately.

Silver halide grains contained in the photographic emulsions may have a regular crystal form, such as that of a cube, a tetradecahedron or an octahedron, an irregular crystal form, such as that of a sphere, a tablet or so on, or a composite form thereof. Also, they may be a mixture of silver halide grains having various crystal forms. It is preferable in the present invention that every photographic emulsion should contain grains having regular crystal forms in a proportion of at least 50%, preferably at least 70%, more preferably 90%, to the whole grains therein.

In addition to the emulsions of the above-described kinds, there can be used to advantage an emulsion of the kind which contains tabular grains having an average aspect ratio (a diameter in circle equivalent/thickness ratio) of at least 5, preferably at least 8, in a proportion of more than 50% (based on projected area) to the whole grains therein.

The silver chlorobromide emulsions used in the present invention can be prepared using method as described in, for example, p. Glafkides, *Chemie at Phisique Photographique*, Paul Montel, Paris (1967), G. F. Duffin, *Photographic Emulsion Chemistry*, The Focal Press, London (1966), V. L. Zelikman et al., *Making and Coating Photographic Emulsion*, The focal Press, London (1964), and so on. Specifically, any processes including an acid process, a neutral process, an ammoniacal process and so on may be employed. Suitable methods for reacting a water-soluble silver salt with a water-soluble halide include, e.g., a single jet method, a double jet method, or a combination thereof. Also, a method in which silver halide grains are produced in the presence of excess silver ion (the so-called reverse mixing method) can be employed. On the other hand, the so-called controlled double jet method, in which the pAg of the liquid phase in which silver halide grains are to be precipitated is maintained constant, may be also employed. According to this method, a silver halide emulsion having a regular crystal form and an almost uniform distribution of grain sizes can be obtained.

For the purpose of heightening the sensitivity, increasing contrast and improving on latent image stability and temperature dependence at the time of exposure, it is desirable that the silver halide grains used in the present invention should contain foreign metal ions or complex ions thereof in the localized phase or the substrate. More specifically, it is advantageous to combine the use of an ion or complex ion of a metal chosen from iridium, rhodium, iron or the like mainly for the localized phase with the use of an ion or complex ion of a metal chose from osmium, iridium, rhodium, platinum, ruthenium, palladium, cobalt, nickel, iron or the like mainly for the substrate. Also, these metal ions and complex ions used may be different in kind or concentration between the localized phase and the substrate. Two or more kinds of metal ions or/and complex ions may be used therein.

In addition to the above-cited ions, other metal ions such as cadmium, zinc, lead, mercury and thallium ions can be used.

It is required of silver halide emulsions used for photographic materials to undergo scanning exposure using laser devices or the like to have both aptitude with high intensity exposure and sufficient gradation to secure necessary densities in the controllable range of laser exposure. When semiconductor devices for infrared radiation are used, spectral sensitization in the infrared region is further required of silver halide emulsions. In this case in particular, an improvement in keeping quality becomes necessary. In order to achieve these purposes, it is greatly advantageous to use iridium, rhodium, ruthenium or iron ion or ion complex in particular choosing from among the above-cited ones. A proper amount of such a metal ion or complex ion to be used varies largely depending on the halide composition, the size and the location of the subject for doping. As for the iridium and rhodium ions, they each are preferably used in an amount of from $5\times10^{-9}$ to $1\times10^{-4}$ mole/mole Ag. As for the iron ion, on ther other hand, it is preferably used in an amount of from $5\times10^{-7}$ to $1\times10^{-3}$ mole/mole Ag.

Compounds for providing those metal ions are added directly or in the form of fine silver halide grains previously doped with such metal ions to a water solution of gelatin as a dispersion medium, a water solution of halide, a water solution of a silver salt or another water solution at the time of forming silver halide grains, and dissolved therein. In this manner or the like, the metal ions are introduced into the localized phase and/or another part (e.g., substrate) of silver halide grains relating to the present invention.

Introduction of metal ions usable in the present invention into emulsion grains can be effected by the addition at any stage of grain formation, namely before, during or immediately after grain formation. The addition time can be changed depending on the introduction site of metal ions.

Silver halide emulsions used in the present invention are, in general, sensitized chemically and spectrally.

As for the chemical sensitization, chemical sensitization using chalcogen sensitizers (specifically including sulfur sensitization represented by the addition of unstable sulfur compounds, selenium sensitization using selenium compounds, and tellurium sensitization using tellurium compounds), noble metal sensitization represented by gold sensitization, and reduction sensitization can be employed independently or in combination. Compounds which can be preferably used for chemical sensitization include those described in JP-A-62-215272, from the right lower column at page 18 to the right upper column at page 22.

The emulsions used in the present invention are those of the kind which form latent image predominantly at the grain surface.

To the silver halide emulsions used in the present invention, a wide variety of compounds or precursors thereof can be added for the purpose of prevention of fog and stabilization of photographic functions during production, storage or photographic processing of photographic materials. As suitable examples of such compounds, those described in the above-cited specification, JP-A-62-215272, from 39 to 72 pages, can be given.

Spectral sensitization is carried out in order to confer spectral sensitivities on each emulsion layer of the photographic materials relating to the present invention in a prescribed wavelength region of light. Since the present invention aims at the use of monochromatic high-density light, such as laser or LED beams, for exposure, it is necessary to perform spectral sensitization so as to harmonize with wavelengths of such a bundle of beams. The expression "- - - harmonize with - - - " used herein signifies to perform spectral sensitization using a sensitizing dye of the kind which can provide spectral sensitivities at the wavelengths of a bundle of beams as described above, and so it does not necessarily mean that the sensitivity maximum in spectral sensitization is in accord with the wavelengths of said bundle of beams. Although it is desirable in respects of responsiveness to such a bundle of beams and color separation that the wavelengths corresponding to the spectral sensitivity maximum should be in accord with the wavelengths of said bundle of beams, it is also advantageous to design the wavelengths corresponding to spectral sensitivity maximum so as to purposely deviate from the wavelengths of the bundle of beams with the intention of reducing a sensitivity variation due to, e.g., fluctuation of wavelengths and intensities of laser beams arising from temperature change. In addition, it is also desirable in the present invention that light-sensitive layers other than the subject of the present invention should undergo spectral sensitization by the addition of dyes capable of absorbing light in wavelength regions corresponding to the intended spectral sensitivities (spectral sensitizing dyes). As examples of spectral sensitizing dyes usable for such spectral sensitization, mention may be made of those described in F. M. Harmer, *Heterocyclic compounds-Cyanine dyes and Related compounds*, John Wiley & Sons, New York and London (1964). As for the examples of concrete compounds and spectral sensitization methods, those described in the above-cited specification, JP-A-62-215272, from the right upper column at page 22 to page 38, can be preferably used.

When semiconductor laser devices are used as light source for digital exposure in the present invention, the photographic materials have the need of efficient spectral sensitization at wavelengths ranging from red to infrared region. In order to effect the spectral sensitization in the wavelength region longer than 730 nm in particular, sensitizing dyes described in JP-A-03-15049 (from left upper column at page 12 to left lower column at page 21) or JP-A-03-20730 (from left lower column at page 4 to left lower column at page 15), European Patent No. 0420011 (from 21st line at page 4 to 54th line at page 6), European Patent No. 0420012 (from 12th line at page 4 to 33rd line at page 10), European Patent No. 0443466, and U.S. Pat. No. 4,975,362 are preferably used. Those sensitizing dyes are chemically stable to a considerable extent, and characterized in that since they can adsorb rather strongly to the surface of silver halide grains, they are highly resistant to desorption ascribed to dispersions present together therewith, e.g., coupler dispersions. For sensitizing dyes for infrared sensitization, compounds having a reduction potential of −1.05 (V vs SCE) or more negative, particularly −1.10 or more negative, are suitable. The sensitizing dyes having such a characteristic as described above have an advantage in respects of creation of high sensitivity and stabilization, especially stabilization of sensitivity and latent image.

The measurement of reduction potential can be carried out using phase-discrimination type second higher harmonic AC polarography. Therein, a dropping mercury electrode is used as working electrode, saturated calomel electrode as reference electrode, and platinum as counter electrode.

Also, the reduction potential can be measured by phase-discrimination type second higher harmonic AC volutammetry using platinum as working electrode. The details thereof are described in *Journal of Imaging Science*, vol. 30, pp. 27–35 (1986).

for incorporation of those spectral sensitizing dyes in silver halide emulsions, they may be dispersed directly into emulsions, or they may be dissolved first in an appropriate solvent, such as water, methanol, ethanol, propanol, methyl cellosolve, 2,2,3,3-tetrafluoropropanol or a mixture of two or more thereof, and then added to emulsions. In another manner which may be adopted, the spectral sensitization dyes are converted first into water solutions in the presence of an acid or a base and then added to emulsions, as described in JP-B-44-23389, JP-B-44-27555, JP-B-57-22089 and so on; or they are converted first into water solutions or colloidal dispersions in the presence of surfactants and then added to emulsions, as described in U.S. Pat. Nos. 3,822,135 and 4,006,025, and so on. In still another manner which may be adopted, the spectral sensitizing dyes are dissolved first into solvents immiscible with water in a substantial sense, such as phenoxyethanol, dispersed second into water or hydrophilic colloid, and then added to emulsions. In a further manner which may be used, the sensitizing dyes are dispersed directly into hydrophilic colloids and the resulting dispersions are added to emulsions, as described in JP-A-53-102733 and JP-A-58-105141. As for the time to add the sensitizing dyes to emulsions, the addition may be carried out at any stage of emulsion-making, provided that it has so far been known to be useful. More specifically, the addition can be done before or during the formation of emulsion grains, in a period from immediately after the grain formation till the washing step, before or during the chemical sensitization, in a period from immediately after the chemical sensitization till gelatin of emulsions by cooling, or at the time of the preparation of coating solutions. Although it is general in most cases to carry out the addition in a period from the conclusion of chemical sensitization till the coating operation, it is possible to perform the spectral sensitization simultaneously with chemical sensitization by adding the sensitizing dyes and chemical sensitizers in the same period, as described in U.S. Pat. Nos. 3,628,969 and 4,225,666; or to perform the spectral sensitization prior to chemical sensitization as described in JP-A-58-113928; or to start the spectral sensitization by the addition prior to the conclusion of the precipitation of silver halide grains. Furthermore, it is possible to divide the sensitizing dyes into some portions and to add them in different periods, as taught by U.S. Pat. No. 4,225,666. For instance, it is possible to add one portion of the sensitizing dyes prior to chemical sensitization and the other portion posterior thereto. Also, the sensitizing dyes divided into some portions may be added at different stages of the formation of silver halide grains, respectively, as taught by U.S. Pat. No. 4,183,756 and so on. Among the addition times cited above, the period prior to the emulsion-washing step and the period prior to chemical sensitization are particularly preferred over others.

An amount of those spectral sensitizing dyes added, though can be widely changed according to circumstances, is preferably within the range of $0.5\times10^{-6}$ to $1.0\times10^{-2}$ mole/mole Ag, and more preferably ranges from $1.0\times10^{-6}$ to $5.0\times10^{-3}$ mole/mole Ag.

When sensitizing dyes having their spectral sensitization sensitivities at wavelengths ranging from the red to infrared region are used in the present invention, it is advantageous in particular to use them in combination with the compounds illustrated in JP-A-02-157749, from right lower column at page 13 to right lower column at page 22. When these compounds are used in combination, specific improvements in keeping quality of the photographic materials, processing stability and super sensitization effect can be produced.

Of the compounds illustrated in said patent specification, it is of greater advantage to use the compounds represented by the general formulae (IV), (V) and (VI). These compounds are used in an amount ranging from $0.5\times10^{-5}$ to $5.0\times10^{-2}$ mole/mole Ag, preferably from $5.0\times10^{-5}$ to $1.0\times10^{-2}$ mole/mole Ag, and that corresponding to from 1 to 10,000 times by mole, preferably from 2 to 5,000 times by mole, as much as sensitizing dyes used.

Constitutions applicable to the photographic materials of the present invention are described below. It is necessary for the photographic materials of the present invention that at least three silver halide emulsion layers should be provided on a support and at least two thereof should have their individual spectral sensitivity maxima in the wavelength range longer than 570 nm. The photographic materials of the present invention are subjected to digital scanning exposure using monochromatic high-density light emitted, e.g., from gas laser, light emission diode, semiconductor laser or like devices. For making the exposure system compact and inexpensive, it is desirable in particular to use semiconductor laser devices. In applying cheap, highly stable and compact semiconductor laser devices to the present invention, it is to be desired that at least two light-sensitive layers should have their individual spectral sensitivity maxima in the wavelength range longer than 670 nm. This is because the wavelengths of beams emitted from semiconductor laser devices which are presently available at a low price and can steadily work enough to be put to practical use are only in the rage from the red to infrared region. On the laboratory level, however, radiation of beams in green and blue regions from semiconductor laser devices has been ascertained.

Therefore, there is every reasonable expectation of being able to put such semiconductor devices to practical use by reduction in their production cost and improvement in their stability with the development of production techniques thereof. In the event of realization of such an expectation, it becomes less necessary for at least two layers to have their respective spectral sensitivity maxima at a wavelength longer than 670 nm.

When at least two light-sensitive layers have their individual spectral sensitivity maxima at wavelength of no shorter than 670 nm, it is to be desired that a water-soluble dye represented by the foregoing general formula (IV), (V), (VI), (VII), (VIII), (IX) or (X) should have its absorption maximum at wavelength of no shorter than 670 nm in co-operation with said spectral sensitivity maxima.

It is desirable that at least one coupler capable of forming a color by the coupling reaction with the oxidation product of an aromatic amine compound should be incorporated in every light-sensitive layer present in the photographic materials of the present invention. When the photographic materials of the present invention are used for making full-color hard copies, it is to be desired that at least three kinds of silver halide light-sensitive layers differing in color sensitivity should be provided on a support, and each layer should contain one of the couplers capable of forming yellow, magenta and cyan colors respectively by the coupling reaction with the oxidation product of an aromatic amine compound. Although these three different spectral sensitivity regions can be arbitrarily chosen as far as they can correspond to the wavelengths of light sources used for digital exposure, it is favorable that each nearest pair of spectral sensitivity maxima should be at least 30 nm away from each other. Color forming couplers (Y, M and C) don's bear any particular relationship to the spectral sensitivity maxima (λ1, λ2 and λ3) of the light-sensitive layers in which they are incorporated, respectively. That is to say, 6 (=3×2) sorts of combinations are possible among them. In some case, however, it is favorable from the standpoint of resolving power of human eyes to design the layer sensitive to light in the longest wavelength region so as to produce a yellow color. In addition, these light-sensitive layers of at least three kinds, which are different in spectral sensitivity maximum from one another, are not particularly limited as to the coating order from the support side. From the standpoint of rapid processing, however, it is desirable in some case to arrange the light-sensitive layer comprising silver halide grains having the greatest average size at the highest position. In another case, it is desirable in respect of sharpness to arrange the light-sensitive layer having its spectral sensitivity maximum in the longest wavelength region at the highest position. In still another case, it is desirable in respect of keeping quality of hard copies under exposure to light or so on that the magenta color-forming layer using a pyrazoloazole type magenta coupler should be arranged at the lowest position. Accordingly, 36 sorts of combinations can be made in combining three different spectral sensitivity regions, three kinds of color-forming couplers and arranging orders of light-sensitive layers. The present invention can be applied to all of these 36 sorts of photographic materials. Specific examples of combinations of light sources for digital exposure, spectral sensitivity maxima and color forming couplers are shown in Table 1. However, the present invention should not be construed as being limited to these examples.

TABLE 1

| | Light Source for Digital Scanning Exposure | | Developed | Spectral Sensitivity Maximum (nm) of |
|---|---|---|---|---|
| | Light Source | Wavelength (nm) | Color | Sensitive Material |
| 1 | AlGaInAs (670) | 670 | C | 670 |
| | GaAlAs (750) | 750 | Y | 730 |
| | GaAlAs (810) | 810 | M | 810 |
| 2 | AlGaInAs (670) | 670 | Y | 670 |
| | GaAlAs (750) | 750 | M | 750 |
| | GaAlAs (830) | 830 | C | 830 |
| 3 | AlGaInAs (670) | 670 | M | 670 |
| | GaAlAs (750) | 750 | C | 750 |
| | GaAlAs (810) | 810 | Y | 810 |
| 4 | AlGaInAs (670) | 670 | Y | 670 |
| | GaAlAs (780) | 780 | C | 780 |
| | GaAlAs (830) | 830 | M | 840 |
| 5 | AlGaInAs (670) | 670 | C | 670 |
| | GaAlAs (780) | 780 | M | 780 |
| | GaAlAs (880) | 880 | Y | 880 |
| 6 | GaAlAs (780) | 780 | M | 780 |
| | GaAlAs (830) | 830 | Y | 830 |
| | GaAlAs (880) | 880 | C | 880 |
| 7 | GlGaInAs (633) | 633 | Y | 630 |
| | AlGaInAs (680) | 680 | M | 680 |
| | GaAlAs (780) | 780 | C | 780 |
| 8 | GaAs (900) + SHP[1)] | 450 | Y | 450 |
| | InGaAs (1200) + SHG[1)] | 600 | M | 580 |
| | AlGaInAs (680) | 680 | C | 700 |
| 9 | LED (580) | 580 | C | 580 |
| | LED (670) | 670 | M | 670 |
| | LED (810) | 810 | Y | 810 |

[1)]SHG: Second higher harmonics generated from non-linear optical elements were used.

The way of exposure used in the present invention is described below. The present invention is particularly useful for photographic materials subjected to to scanning type digital exposure in which imagewise exposure is performed scanning light of high density beams, such as laser or LED beams on the photographic material. Therefore, a time to expose silver halide in the photographic material to light means "a time to expose a very small area to light". As for the very small area, the smallest unit to enable the control of the quantity of light for exposure based on individual digitized image data is generally used, and it is called a picture element. Accordingly, an exposure time per picture element is changed in proportion to the size of said picture element. The size of such a picture element depends on the picture element density, and a practical range of the picture element density is from 50 to 2,000 dpi. When the exposure time is defined as a time to expose the picture element with a size corresponding to the picture element density of 400 dpi, a suitable exposure time is below $10^{-4}$ second, especially below $10^{-6}$ second.

To a hydrophilic colloid layer of the photographic materials relating to the present invention, dyes (such as oxonol dyes and cyanine dyes) capable of being decolored during processing, as described in EP-A2-0337490, can be added in addition to the dyes according to the constitution of the present invention for the purpose of improving on security against safelight and so on. Since such dyes include those which show absorption in such a wavelength range as to cause aggravation of color separation when used in an increased amount, it is required to be careful in the choice of the amount of such dyes to be added. Further, it is desirable that dyes for the above-described purpose should be chosen from those which show absorption in a wavelength range overlapping with the wavelengths of the spectral sensitivity maximum of the layer sensitive to light of the longest wavelengths. For the purpose of improving sharpness, it is to be desired that an optical density (I.e., the cologarithm of the intensity of transmitted light) (or a reflection density in case of using a reflecting support) of at least 0.5 at the wavelengths of laser beam used should be given to the photographic materials by the combined use of those dyes and the dyes of the present invention. For the further improvement on sharpness, it is favorable to incorporate at least 12 wt % (preferably at least 14 wt %) of titanium oxide previously received the surface treatment with a di- to tetrahydric alcohol (e.g., trimethylol ethane) in a waterproofing resin layer which constitutes a support. Also, it is desirable to use colloidal silver in an antihalation layer, as described in JP-A-01-239544.

In the photographic materials relating to the present invention, it is also desirable that compounds capable of improving the keeping quality of color images, such as those described in EP-A2-0277589, should be used together with couplers, especially with pyrazoloazole couplers.

More specifically, the combined or individual use of compounds of the kind which can produce chemically inert, substantially colorless compounds by combining chemically with an aromatic amine developing agent remaining after the color development-processing (Compounds F) and/or compounds of the kind which can produce chemically inert, substantially colorless compounds by combining chemically with an oxidized aromatic primary amine developing agent remaining after the color development-processing (Compounds G) has an advantage in that the generation of stains upon storage after photographic processing, which is due to the formation of dyes by the reaction between couplers and an unoxidized or oxidized color developing agent remaining in the photographic film after the photographic processing, and the occurrence of other side reactions can be prevented effectively.

For the purpose of preventing various kinds of molds and bacteria from propagating in hydrophilic colloid layers to deteriorate images, it is desirable that antimolds as described in JP-A-63-271247 should be added to the photographic materials relating to the present invention.

As for the support used for the photographic materials relating to the present invention, a white polyester support or a support having a white pigment-containing layer on the side of silver halide emulsion layers can be used for display. For bringing about a further improvement in sharpness, it is desirable that an antihalation layer should be provided on the silver halide emulsion layer's side or the back side of the support. In particular, it is preferable to adjust the transmission density of the support to the range of 0.35 to 0.8 so that the display can be observed with both transmitted and reflected light.

Also, a transparent support can be used to advantage as the support for the photographic materials relating to the present invention. Herein, an antihalation layer is preferably provided on the silver halide emulsion layer's side or the surface of the support.

The exposed photographic materials are subjected to conventional black-and-white or color development processing. In case of color photographic materials, the color development is preferably followed by bleach-fix processing for the purpose of rendering the photographic processing rapid. On the occasion that the foregoing emulsions with a high chloride content are used, it is desirable that the pH of a bleach-fix bath should be adjusted to lower than about 6.5, particularly lower than about 6, for the purpose of accelerating the desilvering step.

As suitable examples of silver halide emulsions, other ingredients (such as additives, etc.) and photographic constituent layers (including their arranging order), which can be applied to the photographic materials relating to the present invention, and as suitable examples of processing methods and additives for processing solutions which can be used in processing the photographic materials relating to the present invention, mention may be made of those described in the following patent specifications, especially EP-A2-035560 (corresponding to JP-A-02-139544).

TABLE 2

| Photographic Constituents and Related Matters | JP-A-62-215272 | JP-A-02-33144 | EP-A2-0355660 |
|---|---|---|---|
| Silver halide emulsions | from 6th line in right upper column at page 10 to 5th line in left lower column at page 12, and from 4th line from the bottom of right lower column at page 12 to 17th line in left upper column at page 13 | from 16th line in right upper column at page 28 to 11th line in right lower column at page 29, and from 2nd line to 5th line at page 30 | from 53rd line at page 45 to 3rd line at page 47, and from 20th line to 22nd line at page 47 |
| Silver halide solvents | from 6th line to 14th line in left lower column at page 12, and from 3rd line from the bottom of left upper column at page 13 to the end line in left lower column at page 18 | — | — |
| Chemical sensitizers | from 3rd line from the bottom | from 12th line to end line in | from 4th line to 9th line at |

TABLE 2-continued

| Photographic Constituents and Related Matters | JP-A-62-215272 | JP-A-02-33144 | EP-A2-0355660 |
|---|---|---|---|
| | of left lower column to 5th line from the bottom of right lower column at page 12, and from 1st line in right lower column at page 18 to 9th line from the bottom of right upper column at page 22 | right lower column at page 29 | page 47 |
| Spectral sensitizers (including spectral sensitization methods) | from 8th line from the bottom of right upper column at page 22 to end line at page 38 | from 1st to 13th in left upper column at page 30 | from 10th line to 15th line at page 47 |
| Emulsion stabilizers | from 1st line in left upper column at page 39 to end line in right upper column at page 72 | from 16th line in left upper column to 1st line in right upper column at page 30 | from 16th line to 19th line at page 47 |
| Development accelerators | from 1st line in left lower column at page 72 to 3rd line in right upper column at page 91 | — | — |
| Color couplers (cyan, magenta and yellow couplers) | from 4th line in right upper column at page 91 to 6th line in left upper column at page 121 | from 14th line in right upper column at page 3 to end line in left upper column at page 18, and from 6th line in right upper column at page 30 to 11th line in right lower column at page 35 | from 15th line to 27th line at page 4, from 30th line at page 5 to end line at page 28, from 29th line to 31st line at page 45, and from 23rd line at page 47 to 50th line at page 63 |
| Color formation reinforcing agent | from 7th line in left upper column at page 121 to 1st line in right upper column at page 125 | — | — |
| Ultraviolet absorbents | from 2nd line in right upper column at page 125 to end line in left lower column at page 127 | from 14th line in right lower column at page 37 to 11th line in left upper column at page 38 | from 22nd line to 31st line at page 65 |
| Discoloration inhibitors (image stabilizers) | from 1st line in right lower column at page 127 to 8th line in left lower column at page 137 | from 12th line in right upper column at page 36 to 19th line in left upper column at page 37 | from 30th line at page 4 to 23rd line at page 5, from 1st line at page 29 to 25th line at page 45 from 33rd line to 40th line at page 45, and from 2nd line to 21st line at page 65 |
| High boiling and/or low boiling organic solvents | from 9th line in left lower column at page 137 to end line in right upper column at page 144 | from 14th line in right lower column at page 35 to 4th line from the bottom of left upper column at page 36 | from 1st line to 51st line at page 64 |
| Dispersion methods for photographic additives | from 1st line in left lower column at page 144 to 7th line in right upper column at page 146 | from 10th line in right lower column at page 27 to end line in left upper column at page 28, and from 12th line in right lower column at page 35 to 7th line in right upper column at page 37 | from 51st line at page 63 to 56th line at page 64 |
| Hardeners | from 8th line in right upper column at page 146 to 4th line in left lower column at page 155 | — | — |
| Precursors of developing agent | from 5th line in left lower column to 2nd line in right lower column at page 155 | — | — |
| Development inhibitor releasing compounds | from 3rd line to 9th line in right lower column at page 155 | — | — |
| Supports | from 19th line in right lower column at page 155 to 14th line in left upper colum at page 156 | from 18th line in right upper column at page 39 to 3rd line in left upper column at page 39 | from 29th line at page 66 to 13th line at page 67 |
| Light-sensitive layer constitution | from 15th line in left upper column at page 156 to 14th line in right lower column at page 156 | from 1st line to 15th line in right upper column at page 28 | from 41st line to 52nd line at page 45 |
| Dyes | from 15th line in right lower column at page 156 to end line in right lower column at page 184 | from 12th line in left upper column to 7th line in right upper column at page 38 | from 18th line to 22nd line at page 66 |
| Color stain inhibitors | from 1st line in left upper column at page 185 to 3rd line in right lower column at page 188 | from 8th line to 11th line in right upper column at page 36 | from 57th line at page 64 to 1st line at page 65 |
| Tone modifiers | from 4th line to 8th line in right lower column at page 188 | — | — |
| Stain inhibitors | from 9th line in right lower column at page 188 to 10th | from end line in left upper column to 13th line in right | from 32nd line at page 65 to 17th line at page 66 |

TABLE 2-continued

| Photographic Constituents and Related Matters | JP-A-62-215272 | JP-A-02-33144 | EP-A2-0355660 |
|---|---|---|---|
| | line in right lower column at page 193 | lower column at page 37 | |
| Surfactants | from 1st line in left lower column at page 201 to end line in right upper column at page 210 | from 1st line in right upper column at page 18 to end line in right lower column at page 24, and from 10th line from the bottom of left lower column to 9th line in right lower column at page 27 | — |
| Fluorine-containing compounds (antistatic agent, coating aids, lubricants, adhesion inhibitors, etc.) | from 1st line in left lower column at page 210 to 5th line in left lower column at page 222 | from 1st line in left upper column at page 25 to 9th line in right lower column at page 27 | — |
| Binders (hydrophilic colloids) | from 6th line in left lower column at page 222 to end line in left upper column at page 225 | from 8th line to 18th line in right upper column at page 38 | from 23rd line to 28th line at page 66 |
| Thickening agent | from 1st line in right upper column at page 225 to 2nd line in right upper column at page 227 | — | — |
| Antistatic agent | from 3rd line in right upper column at page 227 to 1st line in left upper column at page 230 | — | — |
| Polymer latexes | from 2nd line in left upper column at page 230 to end line at page 239 | — | — |
| Matting agent | from 1st line in left upper column to end line in right upper column at page 240 | — | — |
| Photographic processing methods (including photographic steps, additives, and so on) | from 7th line in right upper column at page 3 to 5th line in right upper column at page 10 | from 4th line in left upper column at page 39 to end line in left upper column at page 42 | from 14th line at page 67 to 28th line at page 69 |

Note) The quoted paragraphs of JP-A-62-21527 are intended to include the contents of amendments dated March 16 in 1987 which were given in the end of said bulletin.

As for the yellow couplers, so-called blue-shift type ones disclosed in JP-A-63-231451, JP-A-63-123047, JP-A-63-24157, JP-A-01-173499, JP-A-01-213648 and JP-A-01-250944 are preferably used as well as those cited in the above references.

As for the cyan couplers, not only diphenylimidazole type cyan couplers disclosed in JP-A-02-33144 but also 3-hydroxypyridine type cyan couplers disclosed in EP-A2-0333185 (especially one which is prepared by introducing a chlorine atom as a splitting-off group into Coupler (42) cited as a specific example to render the coupler two-equivalent, and Couplers (6) and (9) cited as specific examples) and cyclic active methylene type cyan couplers disclosed in JP-A-64-32260 (especially Couplers 3, 8 and 34 cited as specific examples) are preferably used in addition to those cited in the above references.

As for the processing method applicable to the color photographic materials of the present invention, those described in JP-A-02-207250 are preferred.

A processing temperature of a color developer applicable to the present invention ranges from 20° to 50° C., preferably from 30° to 45° C. It is desirable that a processing time should be shorter than 20 seconds in a substantial sense. As for the replenishment, though it is desirable to use a replenisher in the possible least amount, a proper amount of the replenisher used is in the range of 20 to 600 ml, preferably 50 to 300 ml, more preferably 60 to 200 ml, and most preferably 60 to 150 ml, per $m^2$ of the photographic material processed in the color developer.

As for the development time, it is desirable in the present invention that the time should be within 20 seconds in a substantial sense. The expression "development time" as used herein is defined as the period from the time at which a photographic material has just come into a developing tank till the time at which the material has just come into the next processing tank and, in other words, is intended to include additionally a time to transport the photographic material in the air from the developing tank to the next processing tank.

A suitable pH for the washing or stabilization step ranges from 4 to 10, preferably from 5 to 8. A temperature in such a step, though can be chosen variously depending on the characteristics and the intended use of the photographic materials to be processed, ranges generally from 30° to 45° C., preferably from 35° to 42° C. As for the time to effect such a step, though it can be chosen arbitrarily, it is favorable to finish the step in a short time from the standpoint of saving the processing time. A suitable time ranges from 10 to 45 seconds, particularly from 10 to 40 seconds. As for the replenishment, it is more desirable to replenish the bath in the smaller amount from the standpoints of running cost, reduction of wastes, easiness in handling and son on.

A suitable amount of the solution for the replenishment ranges from 0.5 to 50 times, preferably from 2 to 15 times, the quantity of the processing solution brought from the prebath per unit area of the photographic material. In other words, the amount replenished is below 300 ml, preferably below 150 ml, per $m^2$ of the photographic material. The replenishment may be carried out either continuously or intermittently.

The solution used in the washing and/or stabilization step can further be used in the prior step. For instance, the overflow of washing water, which is reduced in quantity by using the multistage counter current process, is made to flow into a bleach-fix bath arranged as the prebath, and the bleach-fix bath is replenished with a concentrated solution, resulting in the reduction of the waste solution in quantity.

Manners of drying the processed photographic materials which can be used are described below.

in order to finish forming images in accordance with the very rapid processing method of the present invention, it is desirable that a drying time should range from 20 to 40 seconds. As a means of shortening the drying time which can be employed on the side of the photographic material, mention may be made of a reduction in the content of hydrophilic binders, such as gelatin. Owing to the reduction of this kind, the quantity of moisture brought into the photographic film can be lessened to result in shorter drying time. On the other hand, quickening the drying step through the reduction of the moisture content in the photographic material can be effected by passing the photographic material between a pair of squeeze rollers or absorbing the moisture of the photographic material with cloth immediately after the material leaves the washing bath. As for the means of shortening the drying time on the side of a dryer, it is natural to expect that the drying step can be quickened by raising the drying temperature, the blowing force of hot-air, or/and so on. In addition, the drying step can also be quickened by properly adjusting the angle at which the hot-air hits the photographic material or by choosing a proper way to discharge the hot-air.

Now, a preferred embodiment of the present invention is illustrated by referring to the appended drawings. However, the invention should not be construed as being limited to this embodiment.

Figure 1:
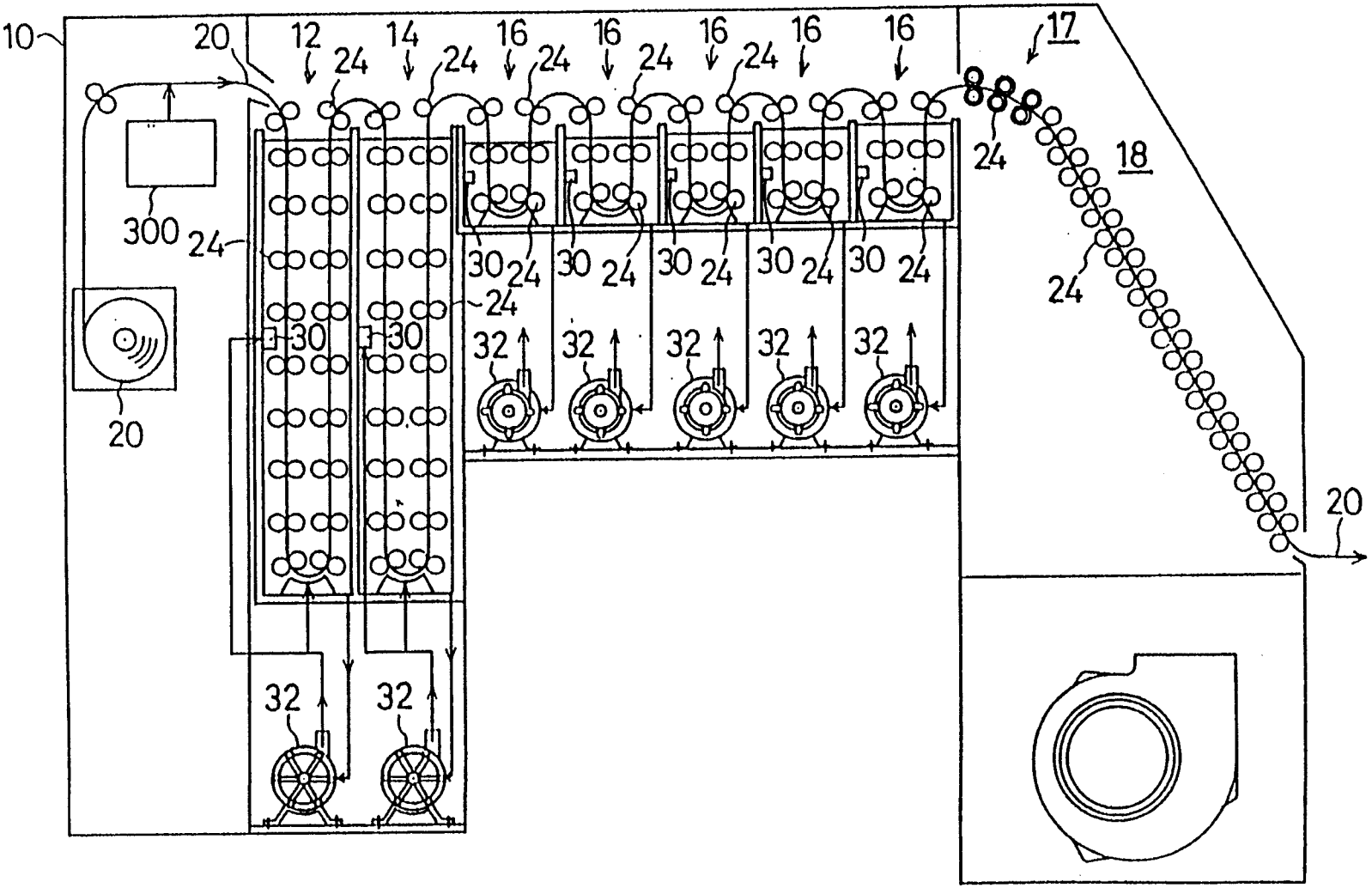
FIG. 1 is a schematic diagram of an image-forming apparatus using color papers of silver halide photography type which are embodiments of the present invention.

FIG. 1 is a schematic diagram of an image-forming apparatus using a color paper of silver salt photography type which is an embodiment of the present invention. In this image-forming apparatus, a color paper is exposed to light and then subjected successively to development, bleach-fix, washing and drying procedures, resulting in the formation of images in the color paper.

The color paper used in the image-forming apparatus (abbreviated as the photographic material, hereinafter) is a color photographic material having on a support at least one emulsion layer which comprises silver halide grains preferably having a chloride content of at least 95 mol %, and undergoes color development by the use of a color developer containing a color developing agent of aromatic primary amine type.

The image-forming apparatus proper is equipped in series with an exposure unit 300, a developing tank 12, a bleach-fix tank 14, washing tanks 16, a draining unit 17 and a drying unit 18. After exposure, the photographic material is processed successively in the developing tank, the bleach-fix tank and the washing tanks, and then dried. The dried photographic material is discharged from the apparatus proper 10. The developing tank 12, the bleach-fix tank 14, the washing tanks 16, the draining unit 17 and the drying unit 18 are each fitted with many pairs of conveying rollers 24. These rollers hold the photographic material 20 between every pair thereof and cause it to travel in each processing tank and from each processing unit to the unit subsequent thereto. Some pair of conveying rollers 24 in the draining unit serve also for moisture removing rollers, which function so as to squeeze the moisture in the photographic material 20 and so as to absorb waterdrops on the photographic material 20 to effect the removal of moisture. Color photographic processing is performed by holding the photographic material 20 between many pairs of conveying rollers 24 with the emulsion face turned downward, and soaking it in each processing bath for a prescribed time while being conveyed. In each of the developing tank 12, the bleach-fix tank 14 and the washing tanks 16, a processing solution-jetting device 30, which sends out a processing solution forcibly to generate a high-speed jet stream inside the processing tank, is fixed at a prescribed position. Further, pumps 32 are installed so as to correspond to the developing tank 12, the bleach-fix tank 14 and the washing tanks 16, respectively. Each processing solution is jetted toward the photographic material 20 from the processing solution-jetting device 30 as it is circulated by means of its corresponding pump 30.

FIG. 2 is a diagram of an exposure unit 300.

The exposure unit 300 emits three different color beams as a set, and thereto is exposed a photographic material 20. More specifically, the exposure unit 300 comprises working driving circuits 242, 244 and 246 based on image data processed with an image processor 240 connected to a computer or the like and driving three kinds of semiconductor laser devices 251, 252 and 253 through their corresponding driving circuits 242, 244 and 246 to emit their individual beams for exposure of the photographic material 20. In the exposure unit 300, a beam of light for developing a magenta color is made by a semiconductor laser device 251 which can emit a laser beam with a wavelength of, e.g., 750 nm. For example, LTO 30MF produced by Sharp Corporation can be used as the semiconductor laser device 251. The laser beam with a wavelength of 750 nm emitted from the semiconductor device 251 is shaped by passing through a collimater lens 258, and reflected by a total reflection mirror 261 so that it may travel to a polygon mirror 270. A beam of light for developing a cyan color is made by a semiconductor laser device 252 which can emit a laser beam with a wavelength of, e.g., 830 nm. The laser beam with a wavelength of 830 nm emitted from the semiconductor device 252 is shaped by passing through a collimate lens 259, and reflected by a dichroic mirror 262, which is designed so as to transmit the beam for developing a magenta color and so as to reflect the beam for developing a cyan color, so that it may travel to the polygon mirror 270. As for the semiconductor laser device 252, TOLD 153R product by Toshiba Electric Co., Ltd., LTO 10MF producted by Sharp Corporation, and so on can be used. A beam of light for developing a yellow color is made by a semiconductor laser device 253 which can emit a laser beam with a wavelength of, e.g., 670 nm. Examples of a semiconductor laser device 252 which can be used herein include TOLD 9200 producted by Toshiba Electric Co., Ltd., NDL 3200 produced by Nippon Electric Co., Ltd. and SLD 151U produced by Sony Corporation. The laser beam with a wavelength of 670 nm emitted from the semiconductor device 253 is shaped by passing through a collimater lens 260, and reflected by a dichroic mirror 263, which is designed so as to transmit the beams for developing magenta and cyan colors respectively and so as to reflect the beam for developing a yellow color, so that it may travel to the polygon mirror 270. The foregoing beams for developing cyan, magenta and yellow colors respectively travel along the same optical path to reach the polygon mirror 270, is reflected thereon, and pass through a F $\theta$ lens 280.

Further, the beams are reflected by a mirror 290, and then reach the photographic material 20. Therein, the polygon mirror 270 is revolving on an axis 271 to enable the beams carrying image data to scan on the photographic material 20. In addition, the photographic material 20 undergoes subscanning by being moved in a direction (indicated by an arrow A) which is orthogonal to the scanning direction of the laser beams, whereby achieving the image formation. Therein, a moving speed of the photographic material 20 is equal to the travelling speed in the photographic processing, and in every individual part of the exposed material 20 is started the development processing after the lapse of the same period time.

Although the above-described exposure unit 300 is designed so as to perform the exposure of the photographic material 20 based on image information processed with a computer or the like, the exposure of the photographic material 20 may also be carried out based on image information obtained directly by reading originals.

EXAMPLE 1

(Preparation of Emulsion "a")

To a 3% water solution of lime-processed gelatin, 3.3 g of sodium chloride was added, and further was added 3.2 ml of N,N,'-dimethylimidazolidine-2-thione (2% water solution). Thereto, a water solution containing 0.2 mole of silver nitrate and a water solution containing 0.2 mole of sodium chloride and 15 $\mu$g of rhodium trichloride were added, and mixed at 56° C. with vigorous stirring. Subsequently, the resulting solution was admixed with a water solution containing 0.78 mole of silver nitrate and a water solution containing 0.78 mole of sodium chloride and 4.2 mg of potassium ferrocyanide at 56° C. with vigorous stirring. After the addition of the silver nitrate solution and the alkali halide solution was concluded, the reaction mixture was admixed with isobutene-monosodium maleate copolymer to cause sedimentation, and then subjected to a washing treatment to effect desalination. The emulsion obtained was admixed with 90.0 g of lime-processed gelatin, and adjusted to pH 6.2 and pAg 6.5. After a 5-minute lapse, the resulting emulsion was admixed with a water solution containing 0.02 mole of silver nitrate and a water solution containing 0.015 mole of potassium bromide, 0.005 mole of sodium chloride and 0.8 mg of potassium hexachloroiridate(IV) at 40° C. with vigorous stirring. After a 10-minute lapse, it was further admixed with $1\times10^{-5}$ mole/mole Ag of a sulfur sensitizer (triethyl thiourea), $1\times10^{-5}$ mole/mole Ag of chloroauric acid and 0.2 g/mole Ag of nucleic acid, and kept at 50° C. till it underwent chemical sensitization to the optimum extent.

The thus obtained silver chlorobromide grains "a" were examined for crystal form, size and size distribution using electromicrophotographs. All the silver halide grains obtained had the crystal form of a cube, an average grain size thereof was 0.52 $\mu$m, and a variation coefficient regarding the size distribution was 0.08. The term grain size used herein refers to the diameter of the circle having the same area as the projected area of the grain, and the variation coefficient corresponds to the quotient of the standard deviation of grain sizes divided by an average grain size.

Further, the halide composition of the emulsion grains was determined by X-ray diffraction analysis of silver halide crystals.

Specifically, diffraction angles from the (200) plane were measured minutely using a monochromatic X-ray of CuK $\alpha$ as a radiation source. The diffraction rays from crystals having a uniform halide composition give a single peak, while those from crystals having localized phases differing in composition give plural peaks corresponding to their individual compositions. The halogen composition of silver halide which constitutes each grain can be determined by calculating the lattice constants from diffraction angles of the peaks measured. As a result of the X-ray diffraction measurement performed under the above-described condition with respect to the silver chlorobromide emulsion prepared in the foregoing manner (Emulsion "a"), there was observed a diffraction pattern having not only a main peak due to 100% silver chloride but also a broad peak centered at 70% silver chloride (30% silver bromide) and trailing its skirt to about 60% silver chloride (40% silver bromide).

(Preparation of Sensitive Material "a")

The surface of a paper support laminated with polyethylene on both sides was subjected to corona discharge, and then provided with a gelatin subbing layer to which sodium dodecylbenzenesulfonate was added. Thereon, various constituent layers described below were further coated to prepare a multi-layer color photographic paper. Coating solutions used therein were prepared in the following manners.

Preparation of Coating Solution for First Layer

A mixture of 19.1 g of an yellow coupler (ExY), 4.4 g of a color image stabilizer (Cpd-1) and 0.70 g of a color image stabilizer (Cpd-7) were dissolved in a mixture of 27.2 ml of ethyl acetate, 4.1 g of a solvent (Solv-3) and 4.1 g of a solvent (Solv-7), and then dispersed in an emulsified condition into 185 ml of a 10% aqueous gelatin solution containing 8 ml of a 10% solution of sodium dodecylbenzenesulfonate. On the other hand, a red-sensitive sensitizing dye (D-1) illustrated below was added to Emulsion "a" prepared in advance. The resulting emulsion was mixed homogeneously with the foregoing emulsified dispersion, and thereto were added other ingredients described below so as to obtain the coating solution for the first layer having the composition described below.

Coating solutions for from the second to seventh layers were prepared respectively in the same manner as that for the first layer. In each layer, sodium salt of 1-oxy-3,5-dichloro-s-triazine was used as hardener.

in addition, compounds (Cpd-10) and (Cpd-11) were added to every constituent layer so as to have total coverages of 25.0 mg/m$^2$ and 50.0 mg/m$^2$, respectively.

Spectral sensitizing dyes (D-1), (D-2) and (D-3) illustrated below were used for light-sensitive emulsion layers respectively.

First Layer: Red-sensitive Yellow color-Forming Layer

-continued (D-1)

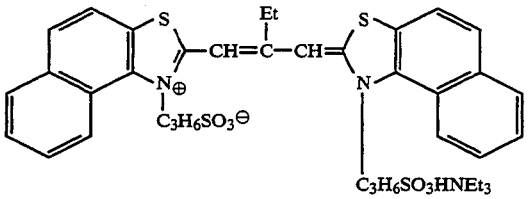

(which was added in an amount of $1.0\times10^{-4}$ mol/mol Ag)

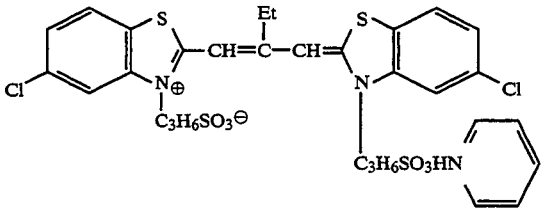

(which was added in an amount of $1.0\times10^{-4}$ mol/mol Ag)

Third Layer: Infrared Sensitive Magenta Color-Forming Layer (D-2)

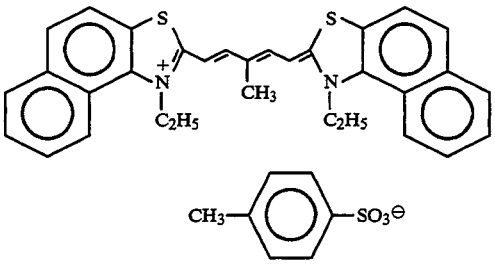

(which was added in an amount of $4.8\times10^{-5}$ mol/mol Ag)

Fifth Layer: Infrared Sensitive Cyan Color-Forming Layer (D-3)

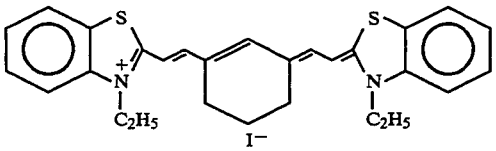

(which was added in an amount of $1\times10^{-5}$ mol/mol Ag)

Further, compounds (Cpd-12) and (Cpd-13) were incorporated as supersensitizer in the magenta color-forming light-sensitive layer and the cyan color-forming light-sensitive layer in amounts of $1.8\times10^{-3}$ mol/mol Ag and $2.0\times10^{-3}$ mol/mol Ag, respectively.

Furthermore, 1-(5-methylureidophenyl)-5-mercaptotetrazole was added in an amount of $8.0\times10^{-4}$ mol/mol Ag to each of the yellow color-, the magenta color- and the cyan color-forming emulsion layers.

(Layer Structure)

The composition of each constituent layer was described below. Each figure on the right side represents a coverage (g/m$^2$) of the ingredient corresponding thereto. As for the silver halide emulsion, the figure represents a coverage based on silver.

Support:

Polyethylene-laminated paper [which contained white pigment ($TiO_2$) and a bluish dye (ultramarine) in the polyethylene laminate on the side of the first layer ]

| | |
|---|---|
| First layer (red-sensitive yellow color-forming layer): | |
| AgClBr emulsion described above (Emulsion "a") | 0.30 |
| Gelatin | 1.22 |
| Yellow Coupler (ExY) | 0.82 |
| Color image stabilizer (Cpd-1) | 0.19 |
| Solvent (Solv-3) | 0.18 |
| Solvent (Solv-7) | 0.18 |
| Color image stabilizer (Cpd-7) | 0.06 |
| Second Layer (color mixing inhibiting layer): | |
| Gelatin | 0.64 |
| Color mixing inhibitor (Cpd-5) | 0.10 |
| Solvent (Solv-1) | 0.16 |
| Solvent (Solv-4) | 0.08 |
| Third layer (infrared-sensitive magenta color-forming layer): | |
| AgClBr emulsion (Emulsion "a") | 0.12 |
| Gelatin | 1.28 |
| Magenta coupler (ExM) | 0.23 |
| Color image stabilizer (Cpd-2) | 0.03 |
| Color image stabilizer (Cpd-3) | 0.16 |
| Color image stabilizer (Cpd-4) | 0.02 |
| Color image stabilizer (Cpd-9) | 0.02 |
| Solvent (Solv-2) | 0.32 |
| Fourth layer (ultraviolet absorbing layer): | |
| Gelatin | 1.41 |
| Ultraviolet absorbent (UV-1) | 0.47 |
| Color mixing inhibitor (Cpd-5) | 0.05 |
| Solvent (Solv-5) | 0.24 |
| Fifth layer (infrared-sensitive cyan color-forming layer): | |
| AgClBr emulsion (Emulsion "a") | 0.23 |
| Gelatin | 1.04 |
| Cyan coupler (ExC) | 0.32 |
| Color image stabilizer (Cpd-2) | 0.03 |
| Color image stabilizer (Cpd-4) | 0.02 |
| Color image stabilizer (Cpd-6) | 0.18 |
| Color image stabilizer (Cpd-7) | 0.40 |
| Color image stabilizer (Cpd-8) | 0.05 |
| Solvent (Solv-6) | 0.14 |
| Sixth layer (ultraviolet absorbing layer): | |
| Gelatin | 0.48 |
| Ultraviolet absorbent (UV-1) | 0.16 |
| Color mixing inhibitor (Cpd-5) | 0.02 |
| Solvent (Solv-5) | 0.08 |
| Seventh layer (protective layer): | |
| Gelatin | 1.10 |
| Acryl-modified polyvinyl alcohol copolymer (modification degree: 17%) | 0.17 |
| Liquid paraffin | 0.03 |

(ExY) Yellow Coupler
1:1 (by mole) mixture of

-continued
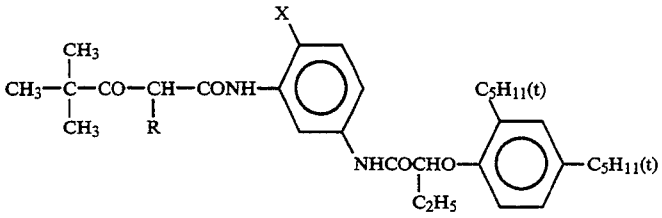
R = 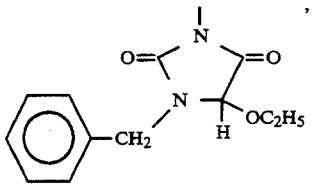 , X = Cl and R = 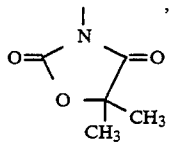 , X = $OCH_3$
(ExY) Magenta Coupler
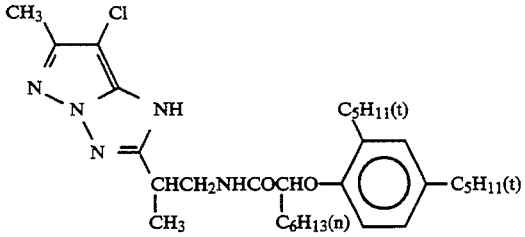
(ExC) Cyan coupler
1:1 (by mole)) mixture of
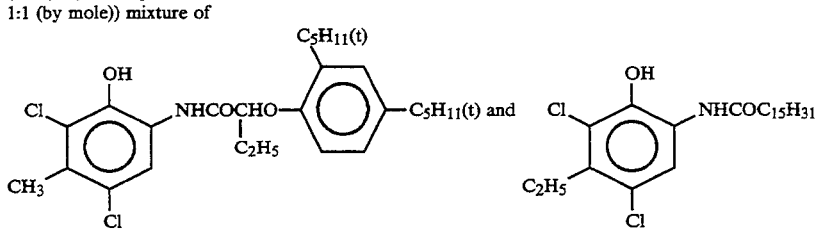
(Cpd-1) Color image stabilizer
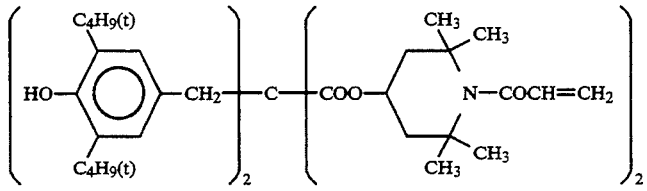
(Cpd-2) Color image stabilizer
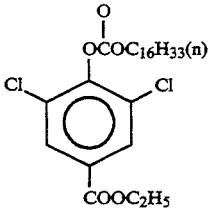
(Cpd-3) Color image stabilizer
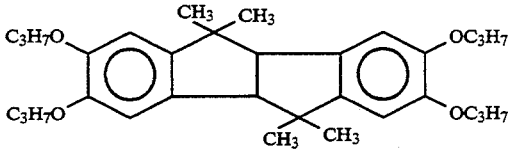
(Cpd-4) Color image stabilizer
1:1 (by mole) mixture of -continued
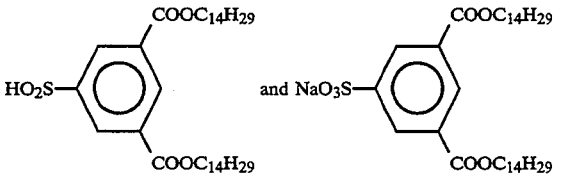
(Cpd-5) Color mixing stabilizer
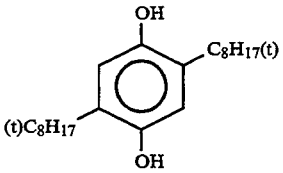
(Cpd-6) Color image stabilizer
2:4:4 (by mole) mixture of
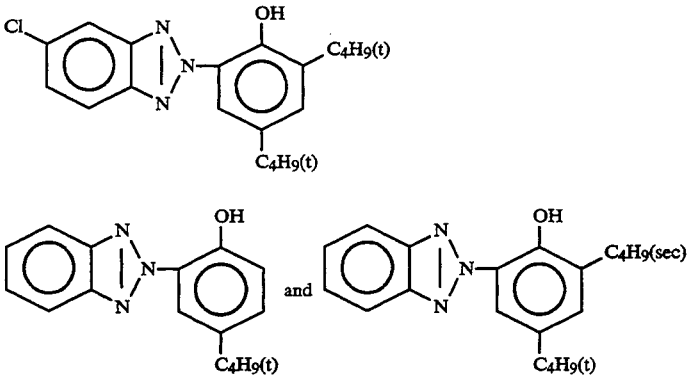
(Cpd-7) Color image stabilizer
$$\left(CH_2-\underset{\underset{CONHC_4H_9(n)}{|}}{CH}\right)_n$$
average molecular weight: 60,000
(Cpd-8) Color image stabilizer
1:1 (by mole) mixture of
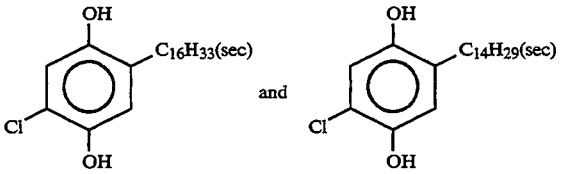
(Cpd-9) Color image stabilizer
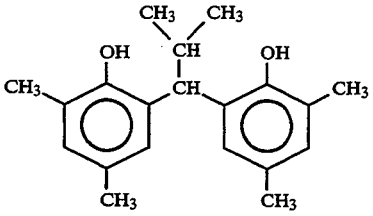
(Cpd-10) Antiseptic
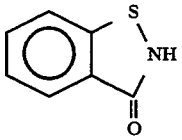
(Cpd-11) Antiseptic -continued
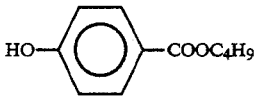
(UV-1) Ultraviolet absorbent
4:2:4 (by weight) mixture of
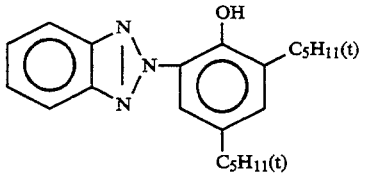
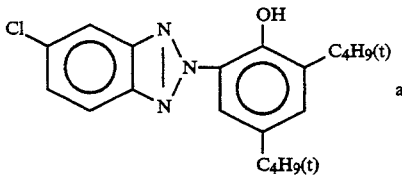
and
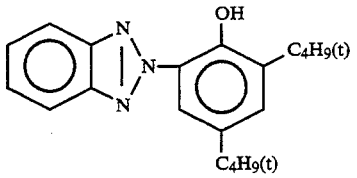
(Solv-1) Solvent
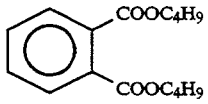
(Solv-2) Solvent
1:1 (by volume) mixture of
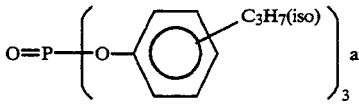
and
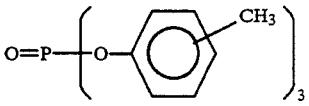
(Solv-3) Solvent
$O{=}P{-}(O{-}C_9H_{19}(iso))_3$
(Solv-4) Solvent
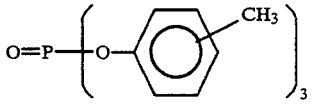
(Solv-5)
$COOC_8H_{17}$
|
$(CH_2)_8$
|
$COOC_8H_{17}$
(Solv-6) Solvent
80:20(by volume) mixture of
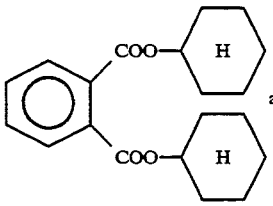
and $C_8H_{17}CHCH(CH_2)_7COOC_8H_{17}$
O
(Solv-7) Solvent
$C_8H_{17}CHCH(CH_2)_7COOC_8H_{17}$
O
(Cpd-12)

-continued

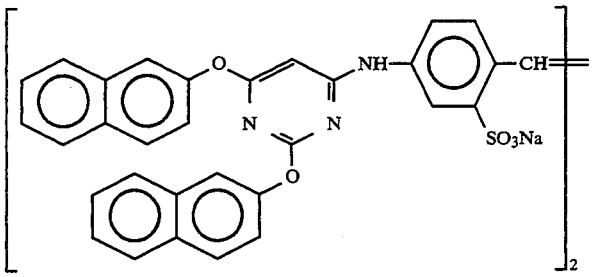

(Cpd-13)

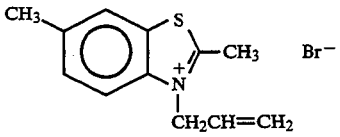

Sensitive materials "b" to "z" were prepared in the same manner as the foregoing sensitive material "a", except that the water soluble dyes set forth in Table 3, which each were divided into two portions of equal weight, were added separately to the second layer (color-stain inhibiting layer) and the fourth layer (ultraviolet absorbing layer) and the fourth layer (ultraviolet absorbing layer) in their respective amounts as shown in Table 3, respectively.

TABLE 3

| Sensitive Material | (Divided Addition to 2nd and 4th Layers) Dye used | Absorption maximum[1)] | Amount added ($mg/m^2$) | Note |
|---|---|---|---|---|
| a | — | — | — | Comparison |
| b | Dye-1 | 765 | 5.0 | Comparison |
| c | Dye-1 | 765 | 10.0 | Comparison |
| d | Dye-1 | 765 | 20.0 | Comparison |
| e | Dye-2 | 760 | 7.5 | Comparison |
| f | Dye-2 | 760 | 15.0 | Comparison |
| g | Dye-2 | 760 | 30.0 | Comparison |
| h | Dye-3 | 795 | 7.5 | Comparison |
| i | Dye-3 | 795 | 15.0 | Comparison |
| j | IV-1 | 720 | 7.5 | Invention |
| k | IV-1 | 720 | 15.0 | Invention |
| l | IV-1 | 720 | 25.0 | Invention |
| m | IV-18 | 750 | 15.0 | Invention |
| n | IV-18 | 750 | 30.0 | Invention |
| o | VI-1 | 725 | 25.0 | Invention |
| p | VI-1 | 725 | 50.0 | Invention |
| q | X-1 | 702 | 24.0 | Invention |
| r | X-1 | 702 | 30.0 | Invention |
| s | V-5 | 710 | 25.0 | Invention |
| t | V-5 | 710 | 50.0 | Invention |
| u | IV-37 | 740 | 25.0 | Invention |
| v | IV-37 | 740 | 50.0 | Invention |
| w | IV-38 | 750 | 25.0 | Invention |
| x | IV-38 | 750 | 50.0 | Invention |
| y | IV-67 | 730 | 25.0 | Invention |
| z | IV-67 | 730 | 50.0 | Invention |

Dye-1

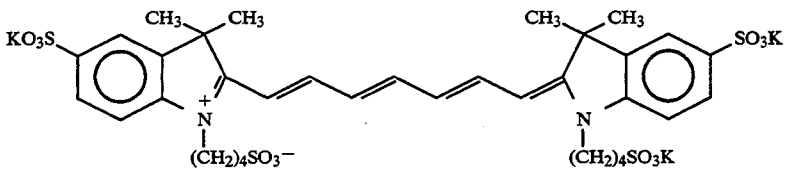

(Dye for comparison)

Dye-2

TABLE 3-continued

| Sensitive Material | (Divided Addition to 2nd and 4th Layers) Dye used | Absorption maximum[1)] | Amount added ($mg/m^2$) | Note |
|---|---|---|---|---|
| | 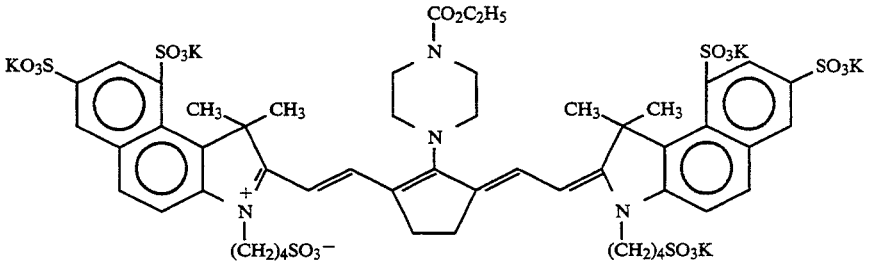 | | | (Dye for comparison) |
| Dye-3 | 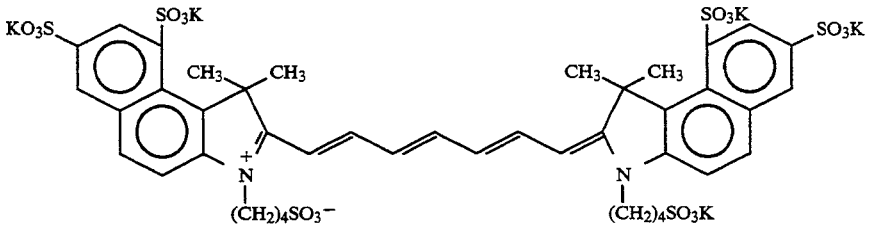 | | | (Dye for comparison) |

[1)]Determined by measuring reflection spectrum of coated films.

The thus prepared sensitive materials each were exposed to light in the following manner.

An AlGaInP semiconductor laser device (oscillation wavelength: about 670 nm), Model No. TOLD9211m made by Toshiba Electric Co., Ltd., a GaAlAs semiconductor laser device 9oscillation wavelength: about 750 nm), Model No. LT030MDO,made by Sharp Corporation, and a GaAlAs semiconductor laser device (oscillation wavelength: about 830 nm), Model No. LT105MDO, made by Sharp corporation, were used as light source. The exposure unit is designed so that by means of a rotating polyhedron the laser beams can be scanned on a color photographic paper moving in the direction perpendicular to the scanning direction of the laser beams. A relationship between the developed color density (D) of each photographic paper and the exposure (E), that is to say, D-log E relationship, was determined by changing the quantity of each laser beam emitted from the laser devices described above. The quantity of each semiconductor laser beam was controlled by the combined use of the pulse width modulation system, in which the quantity of a laser beam was modulated by changing the duration for which an electric current is fed to a semiconductor laser device, and the intensity modulation system in which the quantity of a laser beam is modulated by changing the quantity of an electric current fed thereto. The scanning exposure was carried out under a condition of 400 dpi, and an average exposure time per picture element was about $10^{-7}$ second.

In order to suppress the fluctuation in the quantity of a laser beam emitted, which was due to temperature change, the semiconductor laser devices each were equipped with Pertier element to maintain the temperature constant. The density of a cyan color developed when a color photographic paper was exposed to a laser beam of 750 nm in an exposure amount necessary to give 2.0 of the magenta color density was represented by Dc (750) , and adopted as a measure of color separation. (The greater Dc (750) signifies the worse color separation.)

Resolving power of the developed magenta color was determined by exposing a color photographic paper, on which an optical wedge having various numbers of square pattern within the unit length was put in contact, to light emitted from a sensitometer (made by Fuji Photo Film Co., Ltd.) wherein a 750 nm interference filter of evaporated-film type was attached to the light source thereof. The number C (lines/mm) providing 0.5 of the CFT value was adopted as an index of resolving power. The CTF value herein used is defined as a $\Delta Dc/\Delta Do$ ratio, wherein $\Delta Do$ represents a density difference between the high density area and the low density area each produced depending on the low exposure amount and the high exposure amount of light when the exposure to light was carried out through the optical wedge wherein the number of the square pattern is zero within the unit length, while $\Delta Dc$ represents a density difference between the areas as described above except that the number of the square pattern within the unit length is C (lines/mm). (The greater value of C signifies the higher resolving power.)

The thus exposed samples were each subjected to the following photographic processing.

(Photographic Processing)

After the photographic processing consisting of the following processing steps was performed continuously with a paper processing machine untill the total amount of the replenisher used for color development became twice the volume of a color developing tank used, thereby achieving a stationary processing condition (running processing), the processing for evaluation of the foregoing exposed samples each was carried out.

| Processing Step | Temperature | Time | Amount replenished* | Tank Volume |
|---|---|---|---|---|
| Color Development | 35° C. | 45 sec. | 161 ml | 17 l |
| Bleach-Fix | 30–35° C. | 45 sec. | 215 ml | 17 l |
| Rinsing (1) | 30–35° C. | 20 sec. | — | 10 l |
| Rinsing (2) | 30–35° C. | 20 sec. | — | 10 l |
| Rinsing (3) | 30–35° C. | 20 sec. | 350 ml | 10 l |
| Drying | 70–80° C. | 60 sec. | | |

*per $m^2$ of sensitive material.

(the rinsing was carried out according to the 3-stage counter-current process from the step (3) to the step (1)

.

The composition of each processing solution used was described below.

| | Tank Soln. | Replenisher |
|---|---|---|
| Color Developer: | | |
| Water | 800 ml | 800 ml |
| Ethylenediamine-N,N,N',N'-tetramethylene-phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-bis(carboxymethyl)hydrazine | 4.0 g | 5.0 g |
| Monosodium N,N-di(sulfoethyl)hydroxylamine | 4.0 g | 5.0 g |
| Brightening agent (WHITEX 4B, products of Sumitomo Chemical Industry Co., Ltd.) | 1.0 g | 2.0 g |
| Water to make | 1000 ml | 1000 ml |
| pH (25° C.) adjusted to | 10.05 | 10.45 |
| Bleach-Fix Bath (Tank Solution = Replenisher): | | |
| Water | 400 ml | |
| Alumonium thiosulfate (700 g/l) | 100 ml | |
| Sodium sulfite | 17 g | |
| Ammonium ethylenediaminetetraacetonato-ferrate(III) | 55 g | |
| Disodium ethylenediaminetetraacetate | 5 g | |
| Ammonium bromide | 40 g | |
| Water to make | 1000 ml | |
| pH (25° C.) adjusted to | 6.0 | |

Rinsing Solution (Tank solution=Replenisher)

Ion exchange water (concentrations of calcium and magnesium each were below 3 ppm).

Results obtained are shown in Table 4.

TABLE 4

| Sensitive Material | Color Stain Dc (750) | Sharpness (Magenta) C (lines/mm: CTF = 0.5) | Note |
|---|---|---|---|
| a | 0.23 | 9.1 | Comparison |
| b | 0.35 | 11.3 | Comparison |
| c | 0.60 | 12.9 | Comparison |
| d | 1.32 | 13.9 | Comparison |
| e | 0.32 | 10.6 | Comparison |
| f | 0.34 | 11.3 | Comparison |
| g | 0.46 | 12.6 | Comparison |
| h | 0.33 | 10.9 | Comparison |
| i | 0.45 | 13.1 | Comparison |
| j | 0.24 | 10.6 | Invention |
| k | 0.24 | 11.1 | Invention |
| l | 0.25 | 13.3 | Invention |
| m | 0.24 | 10.9 | Invention |
| n | 0.25 | 12.4 | Invention |
| o | 0.24 | 11.0 | Invention |
| p | 0.24 | 13.1 | Invention |
| q | 0.24 | 10.5 | Invention |
| r | 0.26 | 11.0 | Invention |
| s | 0.23 | 11.5 | Invention |
| t | 0.25 | 13.1 | Invention |
| u | 0.24 | 13.4 | Invention |
| v | 0.25 | 14.5 | Invention |
| w | 0.24 | 13.3 | Invention |
| x | 0.24 | 14.7 | Invention |
| y | 0.24 | 13.0 | Invention |
| z | 0.25 | 14.3 | Invention |

As can be seen from the data shown in Table 4, the sensitive materials from "j" to "z" wherein were used water-soluble dyes according to the present invention were high in sharpness and attended with no aggravation of color separation.

On the other hand, the sensitive materials from "b" to "i" to which were applied dyes beyond the scope of the present invention were attended by considerable aggravation of color separation though they had satisfactorily high sharpness.

EXAMPLE 2

Sensitive materials from "A" to "J" were each prepared so as to have the same constitution as the sensitive material "a", except that each of the water soluble dyes shown in Table 5 (that is, those which have their individual absorption maxima at a wavelength shorter than 700 nm in an incorporated-in-film condition) was added separately to the second layer (color-stain inhibiting layer) and the fourth layer (ultraviolet absorbing layer) in an amount as set forth in Table 5.

TABLE 5

| Sensitive Material | (Divided Addition to 2nd and 4th Layers) Dye used | Absorption maximum[1)] | Amount added ($mg/m^2$) | Note |
|---|---|---|---|---|
| a | — | — | — | Comparison |
| A | Dye-10 | 670 | 10.0 | Comparison |
| B | Dye-10 | 670 | 20.0 | Comparison |
| C | Dye-10 | 670 | 40.0 | Comparison |
| D | Dye-11 | 688 | 20.0 | Comparison |
| E | Dye-11 | 688 | 40.0 | Comparison |
| F | V-3 | 683 | 20.0 | Invention |
| G | V-3 | 683 | 50.0 | Invention |
| H | VIII-1 | 674 | 10.0 | Invention |
| I | VIII-1 | 674 | 20.0 | Invention |
| J | VIII-1 | 674 | 50.0 | Invention |

Dye-10

TABLE 5-continued

| Sensitive Material | (Divided Addition to 2nd and 4th Layers) Dye used | Absorption maximum[1)] | Amount added (mg/m²) | Note |
|---|---|---|---|---|
| | 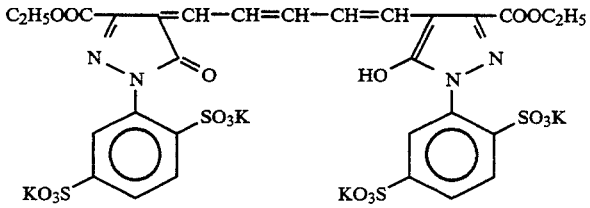 | | | (Dye for comparison) |
| | Dye-11 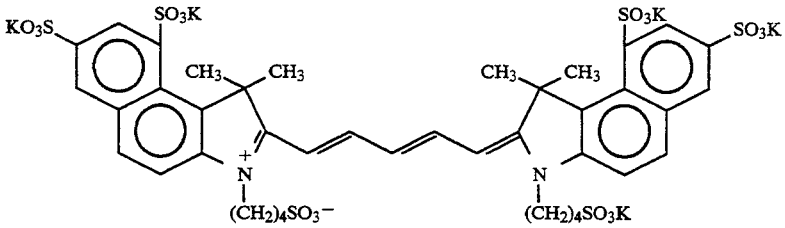 | | | (Dye for comparison) |

[1)]Determined by measuring reflection spectrum of coated films.

Each of these sensitive materials was subjected to scanning exposure in the same manner as described in Example 1.

Herein, however, the density of a magenta color developed when a color photographic paper was exposed to a laser beam of 670 nm under such an exposure that the developed yellow color might have a density of 2.0 was represented by $D_M$ (670), and adopted as a measure of color separation.

In determining a resolving power of the developed yellow color, the same criterion as in Example 1 was employed and each color photographic paper, on which an optical wedge having various numbers of square pattern within the unit length was put in contact, was exposed to light emitted from a sensitometer (made by Fuji Photo Film Co., Ltd.) wherein a 670 nm interference filter of evaporated-film type was attached to the light source thereof.

The thus exposed samples each was subjected to the same photographic processing as in Example 1.

Results obtained are shown in Table 6.

TABLE 6

| Sensitive Material | Color Seperation $D_M$ (670) | Sharpness (Yellow) C (lines/mm: CTF = 0.5) | Note |
|---|---|---|---|
| a | 0.33 | 10.5 | Comparison |
| A | 0.39 | 12.3 | Comparison |
| B | 0.42 | 13.9 | Comparison |
| C | 0.47 | 14.2 | Comparison |
| D | 0.47 | 12.6 | Comparison |
| E | 0.60 | 13.9 | Comparison |
| F | 0.34 | 12.4 | Invention |
| G | 0.34 | 13.4 | Invention |
| H | 0.34 | 12.1 | Invention |
| I | 0.35 | 12.8 | Invention |
| J | 0.35 | 13.8 | Invention |

As can be seen from the data shown in Table 6, it became feasible to prepare sensitive materials having high sharpness and attended with no aggravation of color separation only when the water-soluble dyes within the scope of the present invention were used (Sensitive materials from "F" to "J").

On the other hand, it has turned out that the sensitive materials (from "A" to "E") to which were applied dyes beyond the scope of the present invention (including cyanine dyes and oxonol dyes) suffered appreciable aggravation of color separation though they had satisfactorily high sharpness.

EXAMPLE 3

(Preparation of Emulsion "b")

To a 3% water solution of lime-processed gelatin, 3.3 g of sodium chloride was added, and further was added 3.2 ml of N,N'-dimethylimidazolidine-2-thione (2% water solution). Thereto, a water solution containing 0.2 mole of silver nitrate and a water solution containing 0.2 mole of sodium chloride and 15 μg of rhodium trichloride were added, and mixed at 56° C. with vigorous stirring. Subsequently, the resulting solution was admixed with a water solution containing 0.78 mole of silver nitrate and a water solution containing 0.78 mole of sodium chloride and 4.2 mg of potassium ferrocyanide at 56° C. with vigorous stirring. After the addition of the silver nitrate solution and the alkali halide solution was concluded, the reaction mixture was admixed with isobutene-monosodium maleate copolymer to cause sedimentation, and then subjected to a washing treatment to effect desalination. Further, the emulsion obtained was admixed with 90.0 g of lime-processed gelatin, and adjusted to pH 6.2 and pAg 6.5. After a 5-minute lapse, the resulting emulsion was admixed with $2\times10^{-4}$ mole of (D-4) at 50° C., and kept at that temperature for 15 minutes. Thereto, a water solution containing fine grains of silver bromide (grain size: 0.05 μm) in a quantity of 0.02 mole on a silver nitrate basis and 0.8 mg of potassium hexachloroiridate(IV) was further added with vigorous stirring. Furthermore, the resulting emulsion was admixed with $2\times10^{-5}$ mole/- mole Ag of a sulfur sensitizer (triethyl thiourea), $1\times10^{-5}$ mole/mole Ag of chloroauric acid and 0.2 g/mole Ag of nucleic acid, and kept at 50° C. till it underwent chemical sensitization to the optimum extent.

The thus obtained silver chlorobromide grains "b" were examined for crystal form, size and size distribution using electromicrophotographs. All the silver halide grains obtained had the crystal form of a cube, an average grain size thereof was 0.52 μm, and a variation coefficient regarding the size distribution was 0.08. The term grain size used herein refers to the diameter of the circle having the same area as the projected area of the grain, and the variation coefficient corresponds to the quotient of the standard deviation of grain sizes divided by an average grain size.

Further, the halide composition of the emulsion grains was determined by X-ray diffraction analysis of silver halide crystals.

As a result of the X-ray diffraction measurement of the silver chlorobromide emulsion prepared in the foregoing manner (Emulsion "b"), there was observed a diffraction pattern having not only a main peak due to 100% silver chloride but also a broad peak centered at 70% silver chloride (30% silver bromide) and trailing its skirt to about 60% silver chloride (40% silver bromide).

(Preparation of Emulsions "c" and "d")

Emulsions "c" and "d" were prepared in the same manner as Emulsion "b", except that $1\times10^{-4}$ mole of (D-1) and $5\times10^{-5}$ mole of (D-5) were used in place of (D-4), respectively

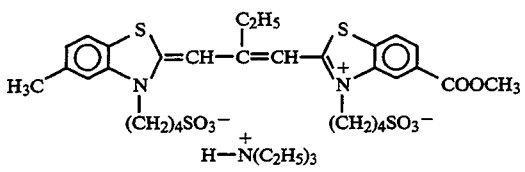

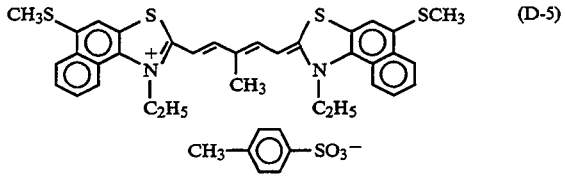

(Preparation of Sensitive Material "α")

Another sensitive material "α" was prepared in the same manner as the sensitive material "a" prepared in Example 1, except that the emulsions "b", "c" and "d" were used in the first, third and fifth layers respectively in place of the emulsion "a" used in the first, third and fifth layers of the sensitive material "a" (and, what is more, the spectral sensitizing dyes were incorporated in advance in the emulsions "b", "c" and "d" respectively at the stage of grain formation tough they were added to separate portions of the emulsion "a" in preparing coating compositions for the foregoing layers of the sensitive material "a"). The sensitive material "α" was comprised of a red-sensitive yellow-color forming layer (first layer) having its spectral absorption maximum in the vicinity of 630 nm, a red-sensitive magenta-color forming layer (third layer) having its spectral absorption maximum in the vicinity of 670 nm and an infrared-sensitive cyan-color forming layer (fifth layer) having its spectral absorption maximum in the vicinity of 750 nm.

In addition, other sensitive materials, from "β" to "ι", were each prepared so as to have the same constitution as the sensitive material "α", except that one of the water soluble dyes of the kind shown in Table 7 (that is, the kind which have their individual absorption maxima at a wavelength shorter than 700 nm in an incorporated-in-film condition) was added separately to the second layer (color-mixing inhibiting layer) and the fourth layer (ultraviolet absorbing layer) in an amount as set forth in Table 7.

TABLE 7

| Sensitive Material | (Divided Addition to 2nd and 4th Layers) Dye used | Absorption maximum[1)] | Amount added ($mg/m^2$) | Note |
|---|---|---|---|---|
| α | — | — | — | Comparison |
| β | Dye-14 | 642 | 20.0 | Comparison |
| γ | Dye-14 | 642 | 50.0 | Comparison |
| δ | Dye-15 | 610 | 20.0 | Comparison |
| ε | Dye-15 | 610 | 50.0 | Comparison |
| ζ | V-3 | 683 | 20.0 | Invention |
| η | V-3 | 683 | 50.0 | Invention |
| θ | IV-6 | 660 | 15.0 | Invention |
| ι | IV-6 | 660 | 30.0 | Invention |

Dye-14

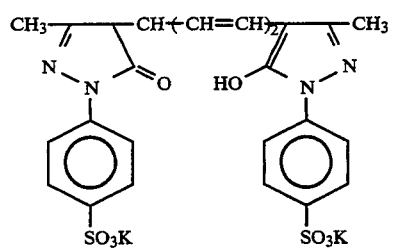

(Dye for comparison)

Dye-15

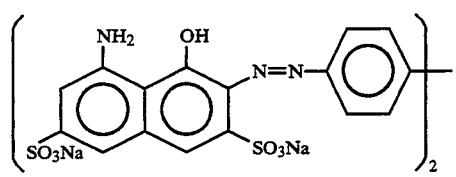

(Dye for comparison)

[1)]Determined by measuring reflection spectrum of coated films.

The thus prepared sensitive materials each were exposed to light in the following manner.

A He-Ne gas laser device (oscillation wavelength: about 633 nm), an AlGaInP semiconductor laser device (oscillation wavelength: about 670 nm), Model No. TOLD9211, made by Toshiba Electric Co., Ltd., and a GaAlAs semiconductor laser device (oscillation wavelength: about 750 nm), Model No. LT030MDO, made by Sharp corporation, were used as light source. The exposure unit is designed so that by means of a rotating polyhedron the laser beams can be scanned on a color photographic paper moving in the direction perpendicular to the scanning direction of the laser beams. A relationship between the developed color density (D) of each photographic paper and the exposure (E), that is to say, D-log E relationship, was determined by changing the quantity of each laser beam emitted from the laser devices described above. The quantity of each semiconductor laser beam was controlled by the combined used of the pulse width modulation system, in which the quantity of a laser beam was modulated by changing the duration for which an electric current is fed to a semiconductor laser device, and the intensity modulation system in which the quantity of a laser beam is modulated by changing the quantity of an electric current fed thereto. The quantity of the gas laser beam was controlled by changing the intensity by means of an external modulator. (In the 633 nm laser beam exposure, the gas laser device will be replaced by a semiconductor laser device if recently developed semiconductor laser devices comes to serve for practical use in the vicinity of 633 nm since semiconductor laser devices have advantages over gas laser devices in respect of compactness, price, facility for modulation and so on.) The scanning exposure was carried out under a condition of 400 dpi, and an average exposure time per picture element was about $10^{-7}$ second. In order to suppress the fluctuation in the quantity of a laser beam emitted, which was due to temperature change, the semiconductor laser devices each were equipped with Pertier element to maintain the temperature constant.

The density of a magenta color developed when a color photographic paper was exposed to a laser beam of 633 nm in an exposure amount necessary to give 2.0 of the yellow color density was represented by $D_M$ (633), and adopted as a measure of color separation.

In determining a resolving power of the developed yellow color, the same criterion as in Example 1 was employed and each color photographic paper, on which an optical wedge having various numbers of square pattern within the unit length was put in contact therewith, was exposed to light emitted from a sensitometer (made by Fuji Photo Film Co., Ltd.) wherein a 633 nm interference filter of evaporated-film type was attached to the light source thereof.

The thus exposed samples each was subjected to the same photographic processing as in Example 1.

Results obtained are shown in Table 8.

TABLE 8

| Sensitive Material | Color Seperation $D_M$ (670) | Sharpness (Yellow) C (lines/mm: CTF = 0.5) | Note |
|---|---|---|---|
| α | 0.31 | 9.6 | Comparison |
| β | 0.37 | 10.8 | Comparison |
| γ | 0.43 | 11.8 | Comparison |
| δ | 0.35 | 11.1 | Comparison |
| ε | 0.40 | 12.6 | Comparison |
| ζ | 0.31 | 12.3 | Invention |
| η | 0.32 | 12.9 | Invention |
| θ | 0.31 | 11.1 | Invention |
| ι | 0.32 | 12.6 | Invention |

As can be seen from the data shown in Table 8, it became feasible to prepare sensitive materials having high sharpness and attended with no aggravation of color separation only when the water-soluble dyes within the scope of the present invention were used (Sensitive materials from "ζ" to "ι".

On the other hand, it has turned out that the sensitive materials (from "β"to "ε") to which were applied dyes beyond the scope of the present invention suffered appreciable aggravation of color separation though they had satisfactorily high sharpness.

EXAMPLE 4

Other sensitive materials, from "a" to "t*", were prepared in the same manner as the sensitive materials, from "a" to "t", prepared in Example 1, except that a gelatin coverage of each constituent layer was changed as follows:

| | |
|---|---|
| First layer | 0.69 g/m² of gelatin |
| Second layer | 0.74 g/m² of gelatin |
| Third layer | 0.82 g/m² of gelatin |
| Fourth layer | 0.61 g/m² of gelatin |
| Fifth layer | 0.89 g/m² of gelatin |
| Sixth layer | 0.40 g/m² of gelatin |
| Seventh layer | 0.62 g/m² of gelatin |

Also, the thus prepared sensitive materials from "a*" to "t*" were subjected to the same exposure and development operations as in Example 1, and then evaluated by the same criterion as in Example 1.

In analogy with the result obtained in Example 1, sensitive materials having high sharpness and attended with no aggravation of color separation were able to be obtained only when the water-soluble dyes within the scope of the present invention were used.

EXAMPLE 5

The sensitive materials from "a" to "t" prepared in Example 1, the sensitive material "a"πand those from "A" to "J" prepared in Example 2, those from "α" to "ι" prepared in Example 3 and those from "a*" to "t*" prepared in Example 4 were each subjected to the same exposure operations as adopted in their respective Examples, and then to the following photographic processing. Thereafter, these sensitive materials were evaluated by the same criterion as employed in their respective Example. As a result of it, it has turned out that only the constitutions according to the present invention can provide sensitive materials having high sharpness and reduced aggravation in color separation.

| Processing Step | Temperature | Time | Amount replenished* | Tank Volume |
|---|---|---|---|---|
| Color Development | 35° C. | 20 sec. | 60 ml | 2 l |
| Bleach-Fix | 30–35° C. | 20 sec. | 60 ml | 2 l |
| Rinsing (1) | 30–35° C. | 10 sec. | — | 1 l |
| Rinsing (2) | 30–35° C. | 10 sec. | — | 1 l |
| Rinsing (3) | 30–35° C. | 10 sec. | 120 ml | 1 l |
| Drying | 70–80'° C. | 20 sec. | | |

*per m² of sensitive material.

(The rinsing was carried out according to the 3-stage counter-current process from the step (3) to the step (1).)

The composition of each processing solution used was described below.

| Color Developer: | Tank Soln. | Replenisher |
|---|---|---|
| Water | 800 ml | 800 ml |
| Ethylenediamine-N,N,N',N'-tetramethylene-phosphonic acid | 1.5 g | 2.0 g |
| Potassium bromide | 0.015 g | — |
| Triethanolamine | 8.0 g | 12.0 g |
| Sodium chloride | 4.9 g | — |
| Potassium carbonate | 25 g | 37 g |
| 4-Amino-3-methyl-N-ethyl-N-(3-hydroxy-propyl)aniline di-p-toluenesulfonate | 12.8 g | 19.8 g |
| N,N-bis(carboxymethyl)hydrazine | 5.5 g | 7.0 g |

-continued

| Color Developer: | Tank Soln. | Re-plenisher |
|---|---|---|
| Brightening agent (WHITEX 4B, products of Sumitomo (Chemical Industry Co., Ltd.) | 1.0 g | 2.0 g |
| Water to make | 1000 ml | 1000 ml |
| pH (25° C.) adjusted to | 10.05 | 10.45 |

A formula of the bleach-fix bath used, and those of rinsing solutions for tank and replenishment use were the same as in Example 1, respectively.

In performing the exposure and photographic processing operation, an apparatus shown in the appended drawing, FIG. 1, was used.

What is claimed is:

1. A silver halide color photographic material which comprises a support having thereon at least three kinds of silver halide light-sensitive layers differing from one another in color sensitivity, each of at least two of the light-sensitive layers comprising silver halide emulsion grains spectrally sensitized with a sensitizing dye providing a spectral sensitivity maximum at wavelength not shorter than 570 nm, said photographic material further containing at least one water-soluble dye represented by the following general formula (IV), (V), (VI), (VIII), (VIII), (IX), or (X) and having an absorption maximum at a wavelength not shorter than 570 nm:

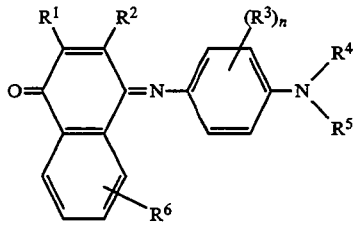

(IV)

wherein $R^1$ represents a hydrogen atom, a halogen atom, a sulfonic acid group, or a group of the formula $CONHR^7$, $SO_2NHR^7$, $NHCOR^7$, $NHCONHR^7$, or $NHSO_2R^7$, wherein $R^7$ represents an unsubstituted or substituted alkyl group, an unsubstituted or substituted aryl group, or a substituted or unsubstituted heterocyclic group; $R^2$ represents a hydrogen atom, an unsubstituted or substituted alkyl group or an unsubstituted or substituted aryl group; $R^3$ represents a hydrogen atom, a halogen atom, an unsubstituted or substituted group, a hydroxyl group, an unsubstituted or substituted alkoxy group, or a group represented by the formula $NHCOR^7$, $NHSO_2R^7$ or $NHCONHR^7$, wherein $R^7$ has the same meaning as described above; $R^4$ and $R^5$ may be the same or different, and each represents an unsubstituted or substituted alkyl group, an unsubstituted or substituted aryl group, an acyl group or a sulfonyl group; $R^4$ may combine with $R^5$ or $R^3$ to form a 5- or 6-membered ring, and $R^5$ also may combine with $R^3$ to form a 5- or 6-membered ring; $R^6$ represents a hydrogen atom, a sulfonic acid group, or a group represented by the formula $NHCOR^7$, $NHSO_2R^7$, $SO_2NHR^7$, wherein $R^7$ has the same meaning as described above; n represents an integer from 1 to 4; provided that at least one of the groups represented by $R^1$, $R^2$, $R^3$, $R^4$, $R^5$ and $R^6$ contains a sulfonic acid group as a substituent:

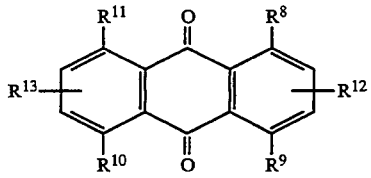

(V)

wherein $R^8$, $R^9$, $R^{10}$ and $R^{11}$ may be the same different, and each represents a hydrogen atom, a halogen atom, a hydroxyl group, an amino group, an unsubstituted or substituted alkylamino group or an unsubstituted or substituted arylamino group; and $R^{12}$ and $R^{13}$ may be the same or different, and each represents a hydrogen atom, a halogen atom or a sulfonic acid group; provided that at least one of the groups represented by $R^8$, $R^9$, $R^{10}$, $R^{11}$, $R^{12}$ and $R^{13}$ contains a sulfonic acid group as a substituent:

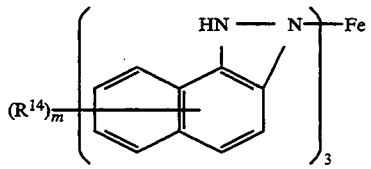

(VI)

wherein $R^{14}$ represents a sulfonic acid group, and m represents an integer from 1 to 6:

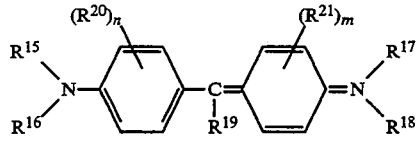

(VII)

wherein $R^{15}$, $R^{16}$, $R^{17}$ and $R^{18}$ may be the same or different, and each represents an unsubstituted or substituted alkyl group, an unsubstituted or substituted aryl group, an acyl group or a sulfonyl group; $R^{19}$ represents an unsubstituted or substituted aryl group, a substituted or unsubstituted heterocyclic group, or a cyano group; $R^{20}$ and $R^{21}$ may be the same or different, and each represents a hydrogen atom, a halogen atom, an unsubstituted or substituted alkyl group; a hydroxyl group, an unsubstituted or substituted alkoxy group, a sulfonic acid group, a carboxyl group or an unsubstituted or substituted amino group; and n and m each represent an integer from 1 to 4; provided that at least one of the groups represented by $R^{15}$, $R^{16}$, $R^{17}R^{18}$, $R^{19}$, $R^{20}$ and $R^{21}$ contains a sulfonic acid group as a substituent:

(VIII)

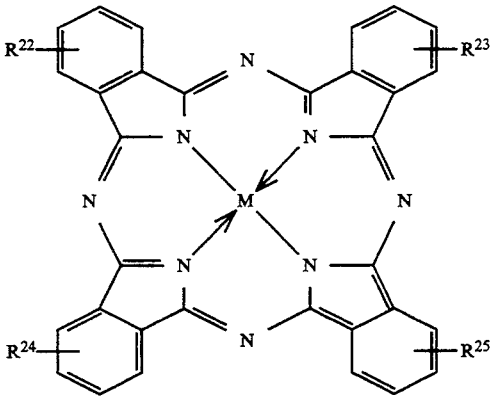

wherein $R^{22}$, $R^{23}$, $R^{24}$ and $R^{25}$ may be the same or different, and each represents a hydrogen atom or a sulfonic acid group; and M represents a hydrogen atom or a metal atom; provided that a dye according to formula (VIII) contains at least two sulfonic acid groups:

(IX)

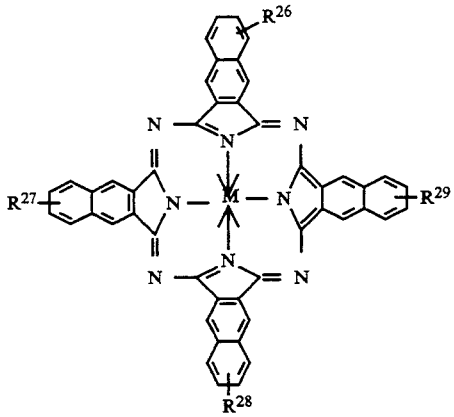

wherein $R^{26}$, $R^{27}$, $R^{28}$ and $R^{29}$ may be the same or different, and each represents a hydrogen atom or a sulfonic acid group; and M represents a hydrogen atom, or a metal atom; provided that a dye according to formula (IX) contains at least two sulfonic acid groups:

(X)

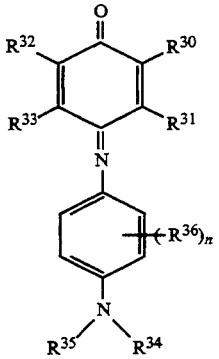

wherein $R^{30}$ represents a hydrogen atom, a halogen atom, or a group represented by the formula $CONHR^{37}$, $NHCOR^{37}$, $COR^{37}$, $CO_2R^{37}$, $NHCONHR^{37}$ or $NHSO_2R^{37}$, wherein $R^{37}$ represents an unsubstituted or substituted alkyl group, an unsubstituted or substituted aryl group, or a unsubstituted or substituted heterocyclic group, $R^{31}$, $R^{32}$ and $R^{33}$ may be the same or different, and each represents a hydrogen atom, a halogen atom, an unsubstituted or substituted alkyl group or a group represented by the formula $NHCOR^{37}$, $NHCONHR^{37}$ or $NHSO_2R^{37}$, wherein $R^{37}$ has the same meaning as described above, or a combination of $R^{32}$ with $R^{33}$ completes a 5- or 6-membered ring; $R^{34}$ or $R^{35}$ may be the same or different, and each represents an unsubstituted or substituted alkyl group, an unsubstituted or substituted aryl group, an acyl group or a sulfonyl group, or each combines with the other or $R^{36}$ to complete a 5- or 6-membered ring; $R^{36}$ represents a hydrogen atom, a halogen atom, an unsubstituted or substituted alkyl group, a hydroxyl group, an unsubstituted or substituted alkoxy group, or a group represented by the formula $NHCOR^{37}$, $NHSO_2R^{37}$ or $NHCONHR^{37}$, wherein $R^{37}$ has the same meaning as described above; and n represents an integer from 1 to 4; provided that at least one of the groups represented by $R^{30}$, $R^{31}$, $R^{32}$, $R^{33}$, $R^{34}$, $R^{35}$ and $R^{36}$ contains a sulfonic acid group as a substituent.

2. The silver halide color photographic material as claimed in claim 1, wherein each of at least two of the light-sensitive layers comprises silver halide emulsion grains spectrally sensitized with a sensitizing dye providing a spectral sensitivity maximum at wavelength of no shorter than 670 nm and at least one of the water-soluble dyes represented by the general formula (IV), (V), (VI), (VII), (VIII), (IX), or (X) has an absorption maximum at wavelength of no shorter than 670 nm.

3. The silver halide color photographic material as claimed in claim 1, wherein the support is a light-reflecting support and at least three of the silver halide light-sensitive layers contain any one of a yellow color-forming coupler, a magenta color-forming coupler and a cyan color-forming coupler respectively.

4. The silver halide color photographic material as claimed in claim 2, wherein the support is a light-reflecting support and at least three of the silver halide light-sensitive layers contain a yellow color-forming coupler, a magenta color-forming coupler and a cyan color-forming coupler respectively.

5. The silver halide color photographic material as claimed in claim 1, wherein the water-soluble dye represented by the general formula (IV), (V), (VI), (VII), (VIII), (IX) or (X) is a dye capable of being dissolved in a quantity of at least 0.2 g in 100 ml of water at 25° C.

6. The silver halide color photographic material as claimed in claim 1, wherein the water-soluble dye represented by the general formula (IV), (V), (VI), (VII), (VIII), (IX) or (X) is a dye capable of being dissolved in a quantity of at least 0.5 g in 100 ml of water at 25° C.

7. The silver halide color photographic material as claimed in claim 1, wherein the water-soluble dye represented by the general formula (IV), (V), (VI), (VII), (VIII), (IX) or (X) is contained in such an amount that a reflectance of the photographic material may be at most 50% when measured at wavelengths of laser beams which are used for exposure.

8. The silver halide color photographic material as claimed in claim 1, wherein the water-soluble dye represented by the general formula (IV), (V), (VI), (VII), (VIII), (IX) or (X) is contained in such an amount that a reflectance of the photographic material may be at most 30% when measured at wavelengths of laser beams used for exposure.

9. The silver halide color photographic material as claimed in claim 1, wherein the sensitizing dye has a reduction potential of −1.05 (V vs SCE) or more negative.

10. The silver halide color photographic material as claimed in claim 1, wherein the sensitizing dyes are each contained in an amount of from $0.5\times10^{-6}$ to $1.0\times10^{-2}$ mole per mole of silver halide.

11. The silver halide color photographic material as claimed in claim 1, wherein the silver halide light-sensitive layers comprise each a silver halide emulsion having a silver chloride content of not less than 95 mol %.

12. A silver halide photographic material which comprises a support having thereon at least three kinds of silver halide light-sensitive layers differing from one another in color sensitivity, each of at least two of the light-sensitive layers comprising silver halide emulsion grains spectrally sensitized with a sensitizing dye providing a spectral sensitivity maximum at wavelength not shorter than 570 nm, said photographic material further containing at least one water-soluble dye represented by the following general formula (IV-I), (IV-II) or (IV-III) and having an absorption maximum at wavelength not shorter than 570 nm:

(IV-I)

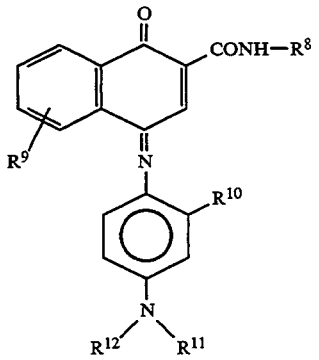

wherein $R^8$ represents an unsubstituted or substituted alkyl group, an unsubstituted or substituted aryl group or a unsubstituted or substituted heterocyclic group; $R^9$ represents a hydrogen atom, a sulfonic acid group, a carboxylic acid group, a hydroxyl group or a halogen atom; $R^{10}$ represents a hydrogen atom, an unsubstituted or substituted alkyl group, an unsubstituted or substituted alkoxy group or an unsubstituted or substituted amino group; and $R^{11}$ and $R^{12}$ may be the same or different, and each being an unsubstituted or substituted alkyl group; provided that the water-soluble dye contains at least 5 acid groups in that at least one of $R^8$, $R^9$, $R^{10}$, $R^{11}$ and $R^{12}$ contains a sulfonic acid group as a substituent:

(IV-II)

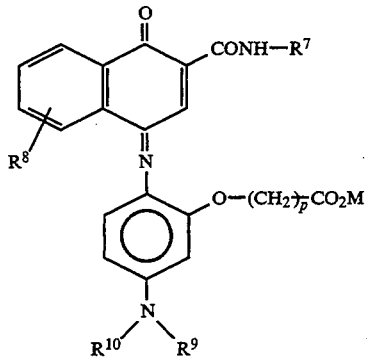

wherein $R^7$ represents an unsubstituted or substituted alkyl group, an unsubstituted or substituted aryl group or a unsubstituted or substituted heterocyclic group; $R^8$ represents a hydrogen atom, a sulfonic acid group or a group represented by NHCOR, $NHSO_2R$, $SO_2NHR$ or NHCONHR, wherein R represents an alkyl group, an aryl group or a heterocyclic group; $R^9$ and $R^{10}$ may be the same different, and each represents an unsubstituted or substituted alkyl group; p represents an integer from 1 to 5; and M represents an organic or inorganic ammonium salt or an alkali metal salt; provided that the water-soluble dye contains at least 3 acidic substituent groups and that at least one of $R^7$, $R^8$, $R^9$ and $R^{10}$ contains a sulfonic acid group as a substituent:

(IV-III)

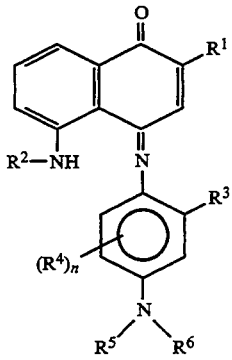

wherein $R^1$ represents a hydrogen atom, a halogen atom, a sulfonic acid group, a carboxylic acid group, or a group of the formula CONHR, $SO_2NHR$, $NHSO_2R$, NHCOR or NHCONHR, wherein R represents an alkyl, or aryl or heterocyclic group; $R^2$ represents a group of the formula $SO_2R$, COR or CONHR, wherein R represents the same meaning as above; $R^3$ and $R^4$ may by the same or different, and each represents a hydrogen atom, an unsubstituted or substituted alkyl group, an unsubstituted or substituted alkoxy group, a hydroxyl group, an unsubstituted or substituted amino group or a halogen atom; $R^5$ and $R^6$ may be the same or different, and each represents an unsubstituted or substituted alkyl group, an unsubstituted or substituted aryl group, an acyl group or a sulfonyl group, or they may combine with each other to complete a 5- or 6-membered ring; and n represents 0 or an integer from 1 to 3; provided that the water-soluble dye contains at least 3 acidic substituent groups, and that at least one of $R^1$, $R^2$, $R^3$, $R^4$, $R^5$ and $R^6$ contains a sulfonic acid group as a substituent.

* * * * *